US012140023B2

(12) United States Patent
Blokshtein et al.

(10) Patent No.: US 12,140,023 B2
(45) Date of Patent: Nov. 12, 2024

(54) SYSTEMS AND METHODS FOR ADAPTIVE TELEMETRY RECEPTION

(71) Applicant: Phoenix Technology Services Inc., Calgary (CA)

(72) Inventors: Lior Blokshtein, Calgary (CA); Rostyslav Kuchma, Calgary (CA); Stephen Nelson David Larson, Calgary (CA)

(73) Assignee: Phoenix Technology Services Inc., Calgary (CA)

( * ) Notice: Subject to any disclaimer, the term of this patent is extended or adjusted under 35 U.S.C. 154(b) by 0 days.

(21) Appl. No.: 18/162,527

(22) Filed: Jan. 31, 2023

(65) Prior Publication Data

US 2023/0243257 A1 Aug. 3, 2023

Related U.S. Application Data

(60) Provisional application No. 63/267,472, filed on Feb. 2, 2022.

(51) Int. Cl.
*E21B 47/18* (2012.01)

(52) U.S. Cl.
CPC ..... *E21B 47/18* (2013.01)

(58) Field of Classification Search
None
See application file for complete search history.

(56) References Cited

U.S. PATENT DOCUMENTS

2022/0195868 A1* 6/2022 Chen ..... G06N 20/00
2022/0251949 A1* 8/2022 Maclean ..... H04L 27/103

FOREIGN PATENT DOCUMENTS

CA 2801868 A1 * 12/2011 ..... E21B 21/08
CN 106437689 A * 2/2017 ..... E21B 47/187
WO WO-2020232460 A1 * 11/2020 ..... E21B 47/12

OTHER PUBLICATIONS

CN-106437689-A English Language Translation (Year: 2017).*
Mwachaka, S.M. et al., "A review of mud pulse telemetry signal impairments modeling and suppression methods", Journal of Petroleum Exploration and Production Technology (2019) 9:779-792.

* cited by examiner

*Primary Examiner* — Curtis A Kuntz
*Assistant Examiner* — Jerold B Murphy
(74) *Attorney, Agent, or Firm* — Oyen Wiggs Green & Mutala LLP; Todd A. Rattray

(57) ABSTRACT

Systems and methods for adaptively receiving telemetry data are disclosed. In one example embodiment of a method, mud pulse telemetry data is transmitted from a downhole location. The transmitted data may be received at a plurality of transducers. Each of the transducers may be positioned at a different location of a drilling operation. The received data from the plurality of transducers may be processed simultaneously. The data which most likely corresponds to the transmitted mud pulse telemetry data may be selected and output. In some embodiments received data from the plurality of transducers is processed with a plurality of different decoding chains. Parameters of individual ones of the decoding chains and/or the number of decoding chains may be autonomously varied.

28 Claims, 14 Drawing Sheets

SYSTEMS AND METHODS FOR ADAPTIVE TELEMETRY RECEPTION

CROSS-REFERENCE TO RELATED APPLICATION

This application claims the benefit under 35 U.S.C. § 119 of U.S. application No. 63/267,472 filed 2 Feb. 2022 and entitled SYSTEMS AND METHODS FOR ADAPTIVE TELEMETRY RECEPTION which is hereby incorporated herein by reference for all purposes.

FIELD

This invention relates to systems and methods for downhole telemetry. Example embodiments provide adaptive systems and methods for receiving downhole mud pulse telemetry data.

BACKGROUND

Subsurface drilling has application, for example, in recovering petrochemicals from subsurface reservoirs. In a typical drilling operation a rotating drill bit at the end of a drill string cuts a borehole. The drill bit may be rotated by turning the entire drill string and/or using a downhole motor such as a mud motor. Cuttings released by the drilling operation are generally removed from the borehole by flowing drilling fluid through the drill string. The drilling fluid flows back to the surface in an annular region of the borehole surrounding the drill string. Subsurface drilling may be used to make boreholes that are very deep (e.g. thousands of meters).

It is common to case a borehole after the borehole has been drilled. Casing typically takes the form of a steel pipe that surrounds the borehole and extends to a desired depth. Casing is used among other things to prevent fluids from entering or leaving the borehole and to preserve the integrity of the borehole. Casing may extend to very significant depths in the borehole.

It can be desirable to establish data communication between downhole equipment within a borehole and surface equipment. Such data communication may, for example, be used to transmit measurements from downhole sensors. The measurements may, for example, include one or more of: measurements of downhole conditions (e.g. temperature, pressure and/or vibration levels), well logging data (e.g. neutron, gamma, magnetic and/or resistivity measurements of formations surrounding the borehole), steering information such as direction (e.g. azimuth) and inclination of a part of the drill string (e.g. the downhole equipment), and/or information regarding the status of items of downhole equipment. This information may be used for a wide variety of purposes including controlling drilling operations, scientific inquiry, mapping downhole formations, etc.

One application of data telemetry is to carry measurement while drilling (MWD) information. MWD is often applied for directional drilling. Various types of directional drilling systems are used. To control these systems from the surface it is necessary to have information regarding the orientation of the drill bit. To provide such information a device commonly known as a MWD tool can be included in the bottom hole assembly (BHA). The MWD tool provides the directional driller with information such as the orientation of the MWD tool and provides periodic measurements of the direction and inclination of the MWD tool in the wellbore, azimuth, inclination, total magnetic field, total gravitational field, dip, gravity tool face, magnetic tool face, raw gravitation readings, raw magnetic readings, etc. The MWD tool encodes this information into a binary data stream that is transmitted to a surface computer that decodes the data stream and presents the information to the directional driller on surface or in a remote location via a suitable data link.

Data telemetry from deep underground is technically challenging. A variety of technologies have been developed for downhole data telemetry. These different technologies each offer tradeoffs between factors such as cost, available data rate, compatibility with existing drilling equipment, and reliability. One technology that is advantageous in some applications is mud pulse (MP) telemetry. MP telemetry transmits data by generating pressure pulses that propagate through drilling fluid in the wellbore. The data is encoded in the pressure pulses. MP telemetry may be used to transmit data over long distances.

In MP telemetry, mud pulses may be detected by positioning a pressure transducer uphole (e.g. at or close to the surface). The pressure transducer senses pressure of the drilling fluid (which includes in itself MP pressure pulses propagating through the drilling fluid) and converts the sensed pulses into an electrical signal that can be processed to retrieve digital information encoded in the MP pressure pulses. A problem is that the MP pressure pulses are small relative to the overall pressure of the drilling fluid. Other components of the pressure measurement such as ambient pressure and noise (e.g. pump noise, noise from a draw works drum, noise from one or more agitators, etc.) can make it hard to detect the MP pressure pulses. This problem is compounded because MP pressure pulses tend to be attenuated and distorted as they propagate uphole due to factors such as erosion, pressure drop across the borehole, etc. Furthermore, the noise picked up by the pressure transducer can change as equipment such as pumps are turned on and off, as drilling conditions change (e.g. depth, rotating vs. sliding modes, stand pipe pressure, etc.), etc. The combination of these factors makes reliable detection of MP pressure pulses difficult, especially where the MP pressure pulses originate from deep in the wellbore.

There remains a need for practical and cost effective ways to perform subsurface telemetry using MP telemetry signals that improve on existing technologies.

SUMMARY

This invention has a number of aspects. These aspects include without limitation:

- systems and methods for receiving mud pulse telemetry data;
- methods for positioning telemetry transducers within a drilling operation;
- methods for assessing quality of received telemetry data;
- methods for decoding telemetry data;
- methods for processing telemetry data from multiple transducers in parallel.

One aspect of the invention provides a method for receiving downhole telemetry data from a drilling operation. The method may comprise transmitting data from a downhole location by mud pulse telemetry. The method may also comprise receiving the transmitted mud pulse telemetry data at a plurality of transducers. Each of the transducers may be positioned at a different location of the drilling operation. The method may also comprise processing the received data from the plurality of transducers to decode the transmitted data. The method may also comprise selecting which one of the decoded data items most likely corresponds to the transmitted mud pulse telemetry data.

In some embodiments processing the received data from the plurality of transducers comprises decoding the received data with a plurality of decoding chains.

In some embodiments the plurality of decoding chains comprises at least one decoding chain for a corresponding one of each of the plurality of transducers.

In some embodiments the plurality of decoding chains comprises at least one set of plurality decoding chains corresponding to at least one of the plurality of transducers.

In some embodiments the decoding chains each comprise at least one filter.

In some embodiments the at least one filter comprises a low pass filter.

In some embodiments the at least one filter comprises a high pass filter.

In some embodiments the received data is filtered by a pump noise filter prior to being processed by the plurality of decoding chains. In some embodiments the pump noise filter is configured to supress pump noise from the received data.

In some embodiments the received data from each of the plurality of transducers is filtered by a different pump noise filter.

In some embodiments the received data from each of the plurality of transducers is autonomously filtered by a different pump noise filter.

In some embodiments settings of the pump noise filter are varied as pump noise varies.

In some embodiments settings of the pump noise filter are autonomously varied as pump noise varies.

In some embodiments the decoding chains each further comprise a clipper configured to clip data relative to a threshold value.

In some embodiments the clippers are configured to clip data which falls below the threshold value.

In some embodiments selecting which one of the decoded data items most likely corresponds to the transmitted mud pulse telemetry data comprises selecting an output of one of the decoding chains which is the most likely to be correct.

In some embodiments the output which is the most likely to be correct is determined by comparing confidence of a plurality of decoded data items.

In some embodiments confidence of a decoded data item is based at least partially on a confidence value that a header corresponding to the decoded data item is correctly identified as a header.

In some embodiments detection of the header is based at least partially on a comparison of a suspected header to a header model.

In some embodiments the header model is varied as header values are correctly decoded.

In some embodiments varying the header model comprises averaging a plurality of correct header values together.

In some embodiments the method comprises varying at least one performance parameter of the plurality of decoding chains to improve the likelihood that at least one decoding chain will correctly decode the received data.

In some embodiments varying at least one performance parameter of the plurality of decoding chains comprises varying filter settings of at least one of the plurality of decoding chains.

In some embodiments filter settings of the at least one of the plurality of decoding chains are varied autonomously.

In some embodiments the method comprises adding or removing decoding chains from the plurality of decoding chains.

In some embodiments the decoding chains are added or removed from the plurality of decoding chains autonomously.

Another aspect of the invention provides a system for receiving downhole telemetry data from a drilling operation. The system may comprise a downhole mud pulse (MP) telemetry transmitter configured to transmit data uphole. The system may also comprise a plurality of transducers configured to sense drilling fluid pressure changes corresponding to transmitted MP telemetry data. The system may also comprise at least one controller configured to perform any method described herein to decode received MP telemetry data.

Another aspect of the invention provides a method for identifying a sequence of pulses representing a header of a mud pulse (MP) telemetry data message. The method may comprise measuring with a transducer changes in pressure of a drilling fluid. At least some of the measured changes in pressure may correspond to encoded MP telemetry data. The method may also comprise comparing a window of measurements from the transducer against a template representing the header to determine a correlation value representing how similar the window of measurements is to the template. The method may also comprise identifying the window of measurements as comprising the header by comparing the correlation value against a threshold value. The method may also comprise dynamically varying the template as windows of measurements comprising the header are identified.

In some embodiments the window of measurements is identified as comprising the header if the correlation value is greater than or equal to the threshold value.

In some embodiments dynamically varying the template comprises averaging the template values with measurement values of the measurement windows identified as comprising the header.

In some embodiments the averaging comprises a weighted average.

In some embodiments the template initially comprises a sequence of expected pressure pulses.

Another aspect of the invention provides a method for detecting mud pulse (MP) telemetry data. The method may comprise measuring with a transducer changes in pressure of a drilling fluid. At least some of the measured changes in pressure may correspond to encoded MP telemetry data. The method may also comprise determining a prototypical shape for the measured changes in pressure corresponding to encoded MP telemetry data. The method may also comprise comparing the measured changes in pressure against the prototypical shape to detect encoded MP telemetry data.

In some embodiments determining the prototypical shape comprises: comparing previously measured changes in pressure that corresponded to encoded MP telemetry data; and determining a shape of the previously measured changes in pressure that has the highest rate of occurrence.

In some embodiments the method comprises selecting the shape of the previously measured changes in pressure that has the highest rate of occurrence as the prototypical shape for the measured changes in pressure corresponding to encoded MP telemetry data.

In some embodiments the method comprises comparing a measured change in pressure against the prototypical shape to determine a likelihood of the measured change in pressure corresponding to encoded MP telemetry data.

In some embodiments the method comprises sorting measured changes in pressure.

In some embodiments the measured changes in pressure are sorted based on energy levels or amplitudes of the measured changes in pressure.

In some embodiments the method comprises selecting ones of the sorted measured changes in pressure which have the highest likelihood of corresponding to encoded MP telemetry data for comparison against the prototypical shape.

In some embodiments the measured changes in pressure having the highest energy levels or amplitudes are selected as having the highest likelihood of corresponding to encoded MP telemetry data.

In some embodiments the method comprises concatenating at least two measured changes in pressure together.

In some embodiments the method comprises determining a quality of the measured changes in pressure.

In some embodiments the quality of the measured changes in pressure is at least partially determined based on the comparison of the measured changes in pressure against the prototypical shape.

In some embodiments the method comprises updating the prototypical shape based on currently detected MP telemetry data.

In some embodiments the measured changes are filtered by a pump noise filter. The pump noise filter may be configured to supress pump noise.

In some embodiments the method comprises varying settings of the pump noise filter as pump noise varies.

In some embodiments settings of the pump noise filter are autonomously varied as pump noise varies.

In some embodiments the method comprises filtering the measured changes with a plurality of pump noise filters. Each of the pump noise filters may be configured to supress pump noise.

In some embodiments the method comprises determining a prototypical shape for the measured changes in pressure corresponding to encoded MP telemetry data for each pump noise filter of the plurality of pump noise filters.

Further aspects and example embodiments are illustrated in the accompanying drawings and/or described in the following description.

It is emphasized that the invention relates to all combinations of the above features, even if these are recited in different claims.

BRIEF DESCRIPTION OF THE DRAWINGS

The accompanying drawings illustrate non-limiting example embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Figure 1:
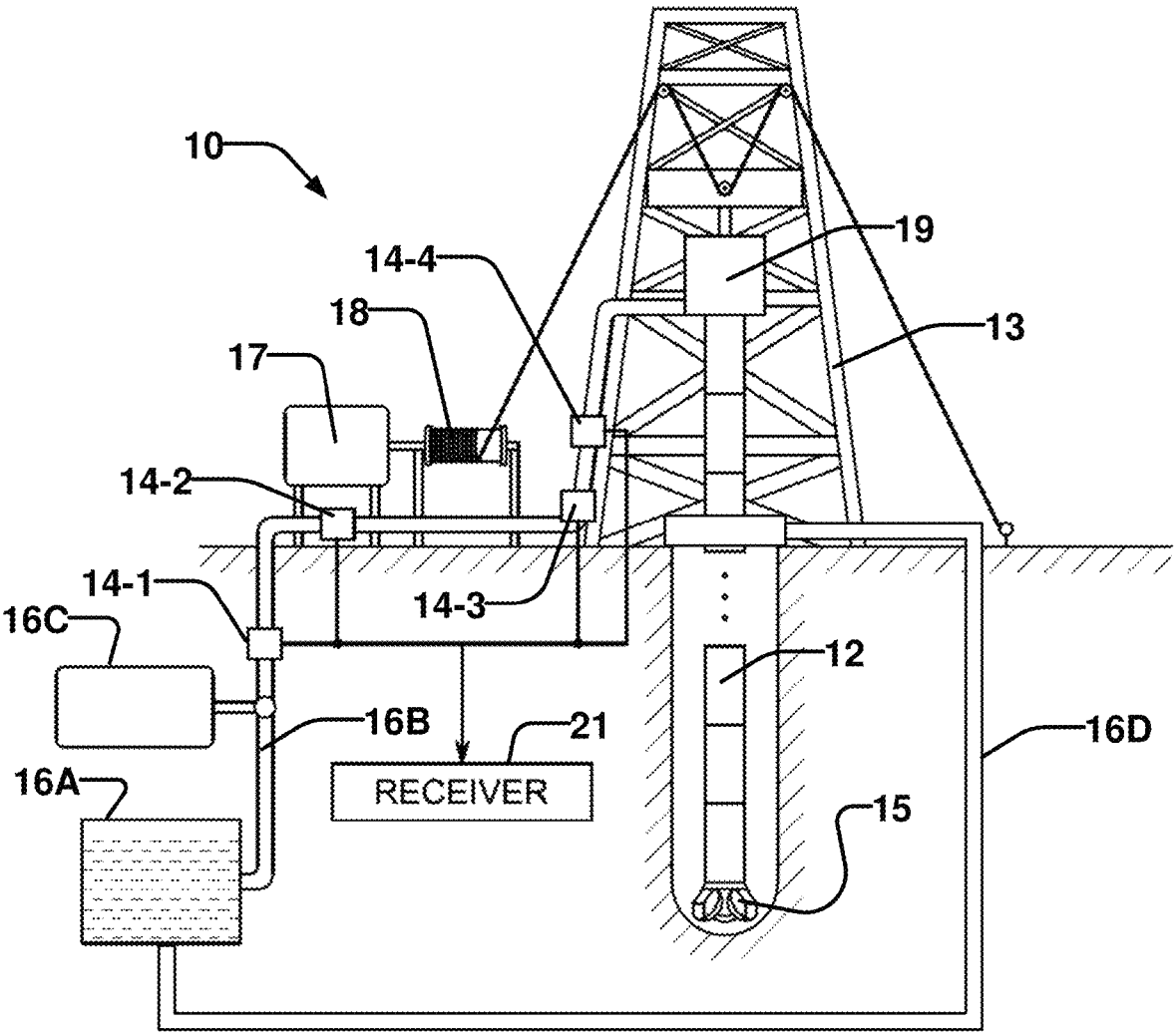
FIG. 1 is a schematic illustration of a drilling operation according to an example embodiment of the invention.

FIG. 1 is a schematic illustration of an example drilling system 10. Drilling system 10 comprises a drill string 12 and derrick 13. Drill string 12 has a cutting and/or drilling tool 15 (e.g. a drill bit) coupled to an end of drill string 12. Drilling fluid (typically called "mud") may be delivered through a bore of drill string 12 to cutting and/or drilling tool 15 during a drilling operation. The drilling fluid is circulated back to the surface in an annulus surrounding drill string 12. In some embodiments (as shown in FIG. 1) drilling fluid is circulated from tank 16A (or a drilling mud pit as may be known in the art) through pipeline 16B by pump 16C to a bore of drill string 12. Drilling fluid may be collected from the annulus surrounding drill string 12 and returned to tank 16A via a pipeline 16D thereby forming a closed loop fluid path. In some embodiments the collected drilling fluid passes through a drilling cuttings separator (not shown) prior to being returned to tank 16A.

Downhole parameters of the drilling operation may be measured and communicated uphole using a telemetry method such as mud pulse telemetry.

In mud pulse telemetry, data that is to be communicated (MP telemetry data) is encoded as a series of pressure pulses in the drilling fluid. The data may, for example, be encoded by a scheme which represents digital values by altering the timing between mud pulses and/or the intensities of mud pulses and/or the types of mud pulses (e.g. positive pressure, negative pressure, "siren" continuous wave signals, etc.). Many different encoding schemes are possible.

MP telemetry data may, for example, comprise a header syncing the data that is being transmitted, the data value(s) being transmitted, one or more error checking values (e.g. a check bit), etc. The pressure pulses are sensed at an uphole location and decoded to receive the transmitted data.

The present technology includes systems which include:

- sensor systems that include multiple sensors (e.g. pressure sensors) at different locations and/or of different types for detecting MP pressure pulses;
- adaptive filtering systems;

These systems may be controlled as described herein to detect MP pressure pulses and/or continuous wave MP signals.

Drilling system 10 may comprise a plurality of transducers 14 (e.g. transducers 14-1, 14-2, 14-3, 14-4) to receive transmitted mud pulse data (i.e. pressure and/or acoustic sensors which sense changes in pressure in the drilling fluid). The plurality of transducers 14 may, for example, comprise a plurality of pressure transducers. The mud pulse data signal and any noise present in the signal will vary (e.g. in amplitude, frequency spectrum, etc.) as a function of position of transducer 14 relative to drilling system 10. Transducers 14 may be positioned along the drilling fluid path (e.g. along pipelines 16B or 16D) at different locations of drilling system 10. For example, transducers 14 may be positioned:

proximate to a mud pump 16C (e.g. transducer 14-1);
proximate to a motor 17 configured to drive a draw-works drum 18 (e.g. transducer 14-2);
proximate to draw-works drum 18 (e.g. transducer 14-3);
proximate to rig 13, drill string 12 or top-drive 19 (e.g. transducer 14-4);
after a pump noise dampener;
etc.

Preferably, at least one transducer 14 is positioned immediately after a pump noise dampener. In some embodiments at least one transducer 14 is positioned to sense fluid pressure (and therefore MP telemetry pulses) within pipeline 16D.

Although drilling system 10 is shown as having four transducers 14, drilling system 10 may have any number of transducers 14. In some embodiments drilling system 10 comprises a plurality of transducers 14. Different transducers 14 may be of the same or different types. For example, transducers 14 may be selected from: absolute pressure transducers; relative pressure transducers; and combinations of relative and absolute pressure transducers. Transducers 14 may interface to drilling system 10 (e.g. pipelines 16B or 16D) in any of a wide range of ways. For example, transducers 14 may comprise one or more strap transducers, one or more in-line transducers, or combinations of strap transducers and in-line transducers.

A data decoding system 20 is connected to receive and process output signals from transducers 14. At different times during a drilling operation different ones of transducers 14 may be less affected by noise, have higher quality, and/or have more faithful reception of mud pulses that encode MP telemetry data than other transducers 14.

System 20 may be configured to select output signals from specific one(s) of transducers 14 that will be processed to recover data that has been transmitted by MP telemetry. System 20 may be configured to select specific processing parameters that will be used to process the output signals at least from the selected transducer(s) 14 to decode the MP telemetry data. Each of these selections may be varied dynamically to obtain high reliability decoded data values from transmitted data. For example, as a drilling operation proceeds, different sets of one or more transducers 14 may be selected for receiving the MP telemetry signals and different processing and/or filtering may be applied to the output signals from the selected transducer(s) 14.

In some embodiments, system 20 comprises one or more trained artificial intelligence models which are configured to select transducer(s) 14 and/or processing and/or filtering to be applied to the output signals of at least the selected transducer(s) 14 for recovering the MP telemetry data.

Figure 2:
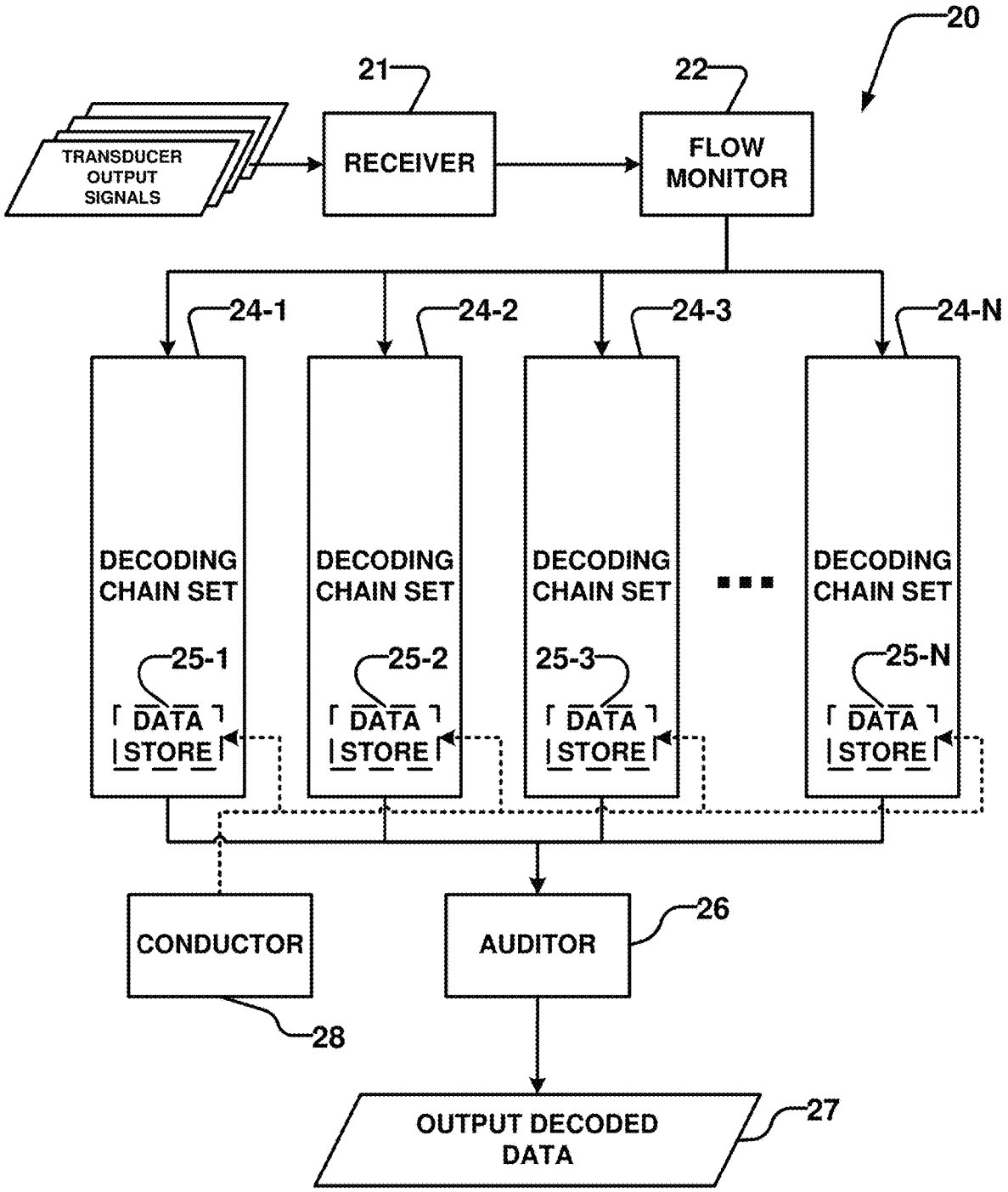
FIG. 2 is a block diagram of an architecture of a decoding system according to an example embodiment of the invention.

FIG. 2 is a block diagram showing an example architecture of decoding system 20.

Receiver 21 receives output signals from transducers 14. In some embodiments receiver 21 comprises one or more analog to digital converters, etc. which convert sensed analog signals from transducers 14 to digital signals. In some embodiments transducers 14 produce digital signals themselves. Receiver 21 may additionally include signal amplifying and/or conditioning electronics (e.g. low pass filters, high pass filters, etc.).

Flow monitor 22 monitors flow of the drilling fluid. MP telemetry data generally requires fluid flow in the drill string to generate the pulses that encode MP telemetry data. Based on the monitored flow, decoding of data may be started or stopped. For example, flow monitor 22 may enable processing to detect/decode MP telemetry data upon detecting fluid flow (i.e. fluid flow is ON) and may disable processing to detect/decode MP telemetry data upon detecting no fluid flow (i.e. fluid flow is OFF).

In some embodiments output signals from at least the selected transducers are delivered from receiver 21 to parts of system 20 that perform downstream processing by way of flow monitor 22. In such embodiments, flow monitor 22 may pass or not pass the output signals for downstream processing based on the monitored flow. In some embodiments receiver 21 directly passes the sensed data for downstream processing. In some such embodiments flow monitor 22 generates signals that enable and disable downstream processing based on the detected flow.

Decoding system 20 also comprises plural sets of decoding chains 24-1, 24-2, . . . , 24-N (each a "decoding chain set 24", generally and collectively "decoding chain sets 24"). Decoding chain sets 24 receive the output signals from the selected transducer(s) 14 and process these output signals to decode and output the MP telemetry data. Each decoding chain set 24 comprises at least one and preferably more than one decoding chain 30 as described elsewhere herein.

Advantageously, decoding chain sets 24 may process output signals from different transducers 14 in parallel. In some embodiments decoding system 20 comprises at least one decoding chain set 24 for each transducer 14. In currently preferred embodiments decoding system 20 does not comprise more than one decoding chain set 24 for a particular transducer 14. In some embodiments if decoded data from a particular chain set 24 is determined to be bad (e.g. low confidence, inaccurate decoded data, etc.) the particular decoding chain set 24 may be removed from decoding system 20 or ignored.

In some embodiments decoding system 20 comprises 10 or fewer decoding chain sets 24. In some embodiments decoding system 20 comprises 8 decoding chain sets 24. In some embodiments decoding system 20 comprises one chain set 24 for each transducer 14.

In some embodiments, decoding chain sets 24 may be implemented at least in part by digital processing by one or more data processors such as one or more digital signal processors (DSPs) and/or one or more microprocessors, etc. In some embodiments decoding chain sets 24 may be implemented at least in part by digital processing by one or more configurable logic devices such as field programmable gate arrays (FPGAs).

In some embodiments decoding chains and/or decoding chain sets 24 may be added to or removed from decoding system 20 dynamically. For example, additional decoding chain sets 24 may be dynamically added to improve quality of the decoding, etc. Decoding chain sets 24 may, for example, be removed to reduce processing time for the output signals of transducers 14, eliminate redundancy, reduce required computational power, etc.

For example, a decoding chain set or decoding chain may be removed from decoding system 20 by one or more of: putting the decoding chain or decoding chain set in a standby mode, ignoring output from the decoding chain or decoding chain set, disconnecting an input signal from the decoding chain or decoding chain set, not powering one or more hardware components, where present, of the decoding chain or decoding chain set, and/or deleting or idling one or more components of the decoding chain or decoding chain set that is implemented in software (e.g. using digital filters/digital processing) under software control. A decoding chain set or decoding chain may be added to decoding system 20 by the opposite of these steps.

Figure 3:
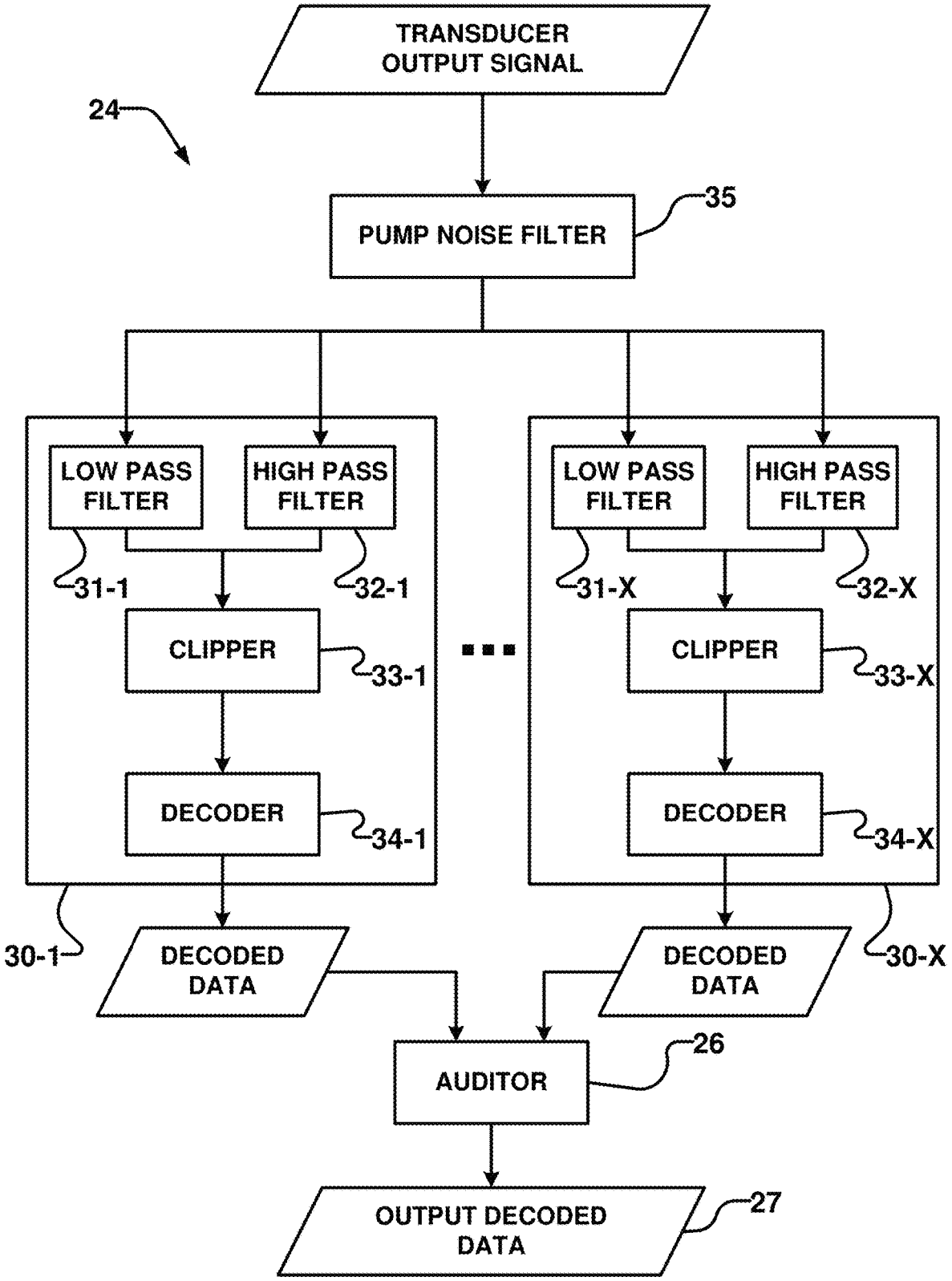
FIG. 3 is a block diagram of an architecture of a decoding chain set according to an example embodiment of the invention.

As shown in FIG. 3 each decoding chain set 24 may comprise a plurality of individual decoding chains 30 (e.g. 30-1, 30-2, 30-3, . . . , 30-X). In some embodiments a decoding chain set 24 initially comprises three or four decoding chains 30. In some embodiments an operator may add additional decoding chains 30 to a decoding chain set 24. In some embodiments a decoding chain set 24 comprises 10 or fewer decoding chains 30. In some embodiments a decoding chain set 24 comprises 8 or fewer decoding chains 30. In some embodiments conductor 28 (described elsewhere herein) dynamically varies the number of decoding chains 30 in a decoding chain set 24.

Each decoding chain 30 receives a transducer output signal from a transducer 14 or from a pump noise filter 35. Decoding chain 30 processes the output signal to decode any MP telemetry data present in the output signal. Typically decoding chain 30 conditions the transducer output signal prior to attempting to decode any MP telemetry data that may be present in the transducer output signal.

Different decoding chain sets 24 may include the same or different numbers of decoding chains 30. Each decoding chain 30 attempts to decode transducer output signals that have been allocated to the corresponding decoding chain set 24. Different decoding chains 30 have different performance parameters (e.g. different filter settings, different filter configurations, different decoder settings, etc.).

In currently preferred embodiments each decoding chain 30 comprises a low pass filter 31 and a high pass filter 32 which filter a transducer output signal received from a transducer 14 or pump noise filter 35. The cutoff frequency of low pass filter 31 may, for example, be higher than the cutoff frequency of high pass filter 32. Low pass filter 31 may remove high frequency noise that may be present in the transducer output signal. In some embodiments low pass filter 31 has a cutoff frequency in the range from about 2 Hz to about 12 Hz. In some embodiments low pass filter 31 comprises a moving average filter. In some embodiments low pass filter 31 comprises a multi-stage filter (e.g. two to four stages). High pass filter 32 may remove a steady state ambient pressure from the transducer output signal.

In some embodiments high pass filter 32 has a cutoff frequency in the range from about 0.5 Hz to about 1.5 Hz. In some embodiments high pass filter 32 comprises a moving average filter. In some embodiments high pass filter 32 comprises a multi-stage filter (e.g. two to four stages).

A difference between the conditioned data from low pass filter 31 and high pass filter 32 may be determined prior to being clipped by clipper 33. Subtracting the data produces a single data signal from which residual noise and steady state ambient pressure are at least partially eliminated.

In some embodiments a bandpass filter is used in place of both low pass filter 31 and high pass filter 32.

The way in which the transducer output data is filtered can affect the likelihood that MP telemetry data can be reliably decoded. At different times, different filtering may yield the best results. Providing plural decoding chains 30 which include different filter combinations for decoding data from the transducer output signals of a transducer 14 increases the likelihood that MP telemetry data will be successfully and reliably decoded by at least one of decoding chains 30.

Clipper 33 removes any negative pressure values from the filtered transducer output signals (i.e. only positive pressure values remain). For example, clipper 33 may be configured to set any negative amplitude values to 0. Clipper 33 is optional and may have significant benefit depending on the nature of the transmitted MP telemetry data. Clipper 33 may, for example, be beneficial where MP telemetry data is encoded in positive pressure pulses.

As shown in FIG. 3, prior to being input into a decoding chain set 24, transducer output signals may be filtered by a pump noise filter 35 (not necessary in all embodiments). Pump noise filters 35 may be configured to suppress pump noise in the transducer output signals.

In some embodiments, pump noise filter 35 is configured to identify and lock onto a frequency corresponding to pump noise which is present in the sensed data. Pump noise filter 35 preferably maintains a frequency lock on the pump noise even if the frequency drifts over time. Based on the identified and locked onto frequency, pump noise filter 35 may comprise one or more notch filters to remove pump noise from the transducer output signals. In some embodiments the frequency lock of pump noise filter 35 is accurate to within at least 10E-4 Hz. Preferably, the frequency lock of pump noise filter 35 is accurate to within at least 10E-5 Hz.

For example, pump noise filter 35 may comprise an artificial intelligence model which is trained to lock onto the frequency corresponding to pump noise.

In some embodiments pump noise filter 35 comprises a series of notch filters. Each notch filter may be designed to remove a specific frequency from the transducer output signals. Each notch filter may be separately tunable. Decoder 34 decodes processed transducer output signals (e.g. filtered and/or clipped transducer output signals) to extract MP telemetry data. MP telemetry data is encoded in sequences of pressure pulses. There are a wide range of protocols for encoding data in pressure pulses. In general, data is encoded by creating patterns in the relative timing and/or amplitudes of a series of pulses. For example, protocols such as phase shift keying (PSK) or quadrature amplitude modulation (QAM) may be used to encode MP telemetry data.

The likelihood of an output from a single decoding chain 30 being correct may be self-evaluated at least partially by decoder 34 based on one or more of the following:

- error check bit comparisons (decoder 34 may evaluate outputs from its decoding chain 30 as being more likely correct where error check bits in the outputs indicate fewer errors than outputs for which the error check bits indicate more errors);
- confidence comparisons which are based on how close decoded data pulses correspond to an expected timing of the pulses (decoder 34 may evaluate outputs from decoding chain 30 for which an input signal has a higher confidence corresponding to an expected timing being detected as being more likely correct than outputs from decoding chain 30 for which the pulse timing does not correspond to the expected timing and therefore the confidence is lower);
- comparison of the outputs of decoding chain 30 to predicted values such as predicted values for inclination or continuous azimuth (decoder 34 may evaluate outputs that match the predicted values more closely as being more likely correct as compared to outputs that match the predicted values less well);
- comparison of the outputs of decoding chain 30 to previous outputs of decoding chain 30 (where an output includes a value that is expected to change slowly such that a difference between the value in a current output and the value in the previous output is expected to be small then decoder 34 may evaluate outputs that are very different from a previous output of the same decoding chain 30 as being less likely correct than outputs that are closer to the previous output of the same decoding chain 30);

etc.

Returning to FIG. 2, system 10 includes a functional unit or component which, among other functions, analyzes and determines which output of which decoding chain 30 to use as the decoded data. This functional unit or component is referred to as "auditor 26" herein. Auditor 26 receives processed data from individual decoding chains 30 of decoding chain sets 24. Auditor 26 analyzes the decoded data from decoding chains 30 and determines which output from which decoding chain 30 to output as decoded MP telemetry data 27. Which data to output as decoded MP telemetry data 27 is determined by comparing the data output by each of decoding chains 30 and determining which output of which decoding chain 30 is most likely to be correct. In some embodiments a user (instead of auditor 26) may select which output from which decoding chain 30 to output as decoded MP telemetry data 27.

Auditor 26 may, for example, comprise an artificial intelligence model which is configured to compare outputs of the different decoding chains 30 and determine which output is most likely to be correct. For example, auditor 26 may compare (e.g. with a comparator) outputs of the different chain sets 24 and/or outputs of individual decoding chains 30 and select the most frequently occurring output value (e.g. based on how many instances of that output value occur compared to the other output values) as the output value that is the most likely to be correct. If, for example, there are two decoding chain sets 24 with four decoding chains 30 each (e.g. 8 decoding chains 30 in total) and six of the decoding chains 30 have an output value of "Gamma=15", one decoding chain 30 has an output value of "Gamma=230" and one decoding chain 30 has an output value of "Gamma=159", then auditor 26 may select the output value of "Gamma=15" as being most likely correct.

Auditor 26 may ensure that MP telemetry data that is output from each decoding chain 30 within a decoding chain set 24 is time synchronized. In some embodiments auditor 26 conditions the output decoded data from decoding chains 30 for the data to be time synchronized. For example, MP telemetry data may be detected at different transducers 14 at different times due to different propagation times from the source of the MP telemetry data to the different transducers 14. The output decoded data corresponding to two transducers 14 may be time synchronized by applying an appropriate delay to the data from the transducer that receives the MP data first or by subtracting an appropriate time value corresponding to the delay. Decoded data 27 may be output to a user (e.g. via a display, print out, etc.), stored, transmitted to a recipient, used to autonomously control one or more drilling parameters of drilling system 10 by a controller of drilling system 10 and/or the like.

System 10 may also include a function unit or component which, among other functions, assesses the performance of decoding chains 30 and/or decoding chain sets 24. This functional unit or component is referred to as "conductor 28" herein. Based on the assessed performance of a decoding chain 30 or decoding chain set 24, conductor 28 may vary one or more performance parameters (e.g. filter settings, decoding settings, etc. as described elsewhere herein) of an assessed decoding chain 30 or add or remove one or more decoding chains 30. By reviewing the performance of decoding chains 30 and/or decoding chain sets 24 on an ongoing basis and modifying performance parameters which affect the operation of individual decoding chains 30 and/or decoding chain sets 24 or adding or removing decoding chains 30, conductor 28 may adaptively modify decoding system 20 to accurately decode MP telemetry data even as conditions for reception of MP telemetry signals change. Examples of factors that can affect the form and/or reception of MP telemetry signals include: drilling fluid flow rate and pressure, depth of the wellbore, depth of a source of the MP telemetry signals, drilling fluid composition, diameter(s) of the wellbore, irregularities in the wellbore, noise from a range of sources including sources such as pumps, drilling, rig machinery, and the condition and operating parameters for the source of MP telemetry signals.

Conductor 28 may assess performance periodically (e.g. every hour, every two hours, every 30 minutes, etc.).

MP telemetry signals may become distorted in various ways as they propagate to a transducer 14. For example, a single transmitted pulse may be received as a sequence of two or more pulses due to reflections and/or dispersion, pulse shapes may be distorted, pulse amplitudes may be altered. These distortions combined with noise can make it very challenging to detect and decode MP telemetry signals, especially where the signals are transmitted from a deep location. Additionally, if the timing of the pulses is not properly ascertainable then the output data will not be correct (e.g. MP telemetry requires detection of pulses with specific timing protocols).

Conductor 28 may, for example, at least partially comprise artificial intelligence.

In some embodiments conductor 28 periodically assesses performance of each decoding chain 30. For example, conductor 28 may maintain or access performance data for each decoding chain 30. The performance data includes data that is indicative of a level of performance of the corresponding decoding chain 30 (e.g. statistical data and/or the like). Conductor 28 may periodically access and assess the performance data to assess performance of decoding chains 30 as currently configured. In some embodiments conductor 28 assesses performance of decoding chains 30 sequentially. In some embodiments conductor 28 assesses performance of decoding chains 30 randomly (e.g. conductor 28 randomly picks which one of decoding chain 30 to assess next). In some embodiments conductor 28 is capable of assessing performance of two or more decoding chains 30 in parallel (e.g. at the same or overlapping times).

Performance parameters (e.g. filter settings, decoding settings, etc.) and/or performance data for each decoding chain 30 may, for example, be stored in a data store 25. In some embodiments decoding system 20 comprises a single data store. In some embodiments each decoding chain set 34 comprises a data store. Conductor 28 may retrieve the performance parameters and/or performance data from data store 25 and/or store new performance parameters in data store 25.

In some embodiments conductor 28 assesses performance of some decoding chains 30 more frequently than other ones of decoding chains 30. In some embodiments decoding chains 30 which are more frequently identified as having data that is unlikely to be correct by auditor 26 may be assessed by conductor 28 more frequently than other decoding chains 30.

As described above, conductor 28 may vary performance parameters of one or more of decoding chain sets 24. Additionally, or alternatively, conductor 28 may add or remove (e.g. activate or disable) a decoding chain set 24. Additionally, or alternatively, conductor 28 may add or remove one or more decoding chains 30 within a decoding chain set 24. Additionally, or alternatively, conductor 28 may vary performance parameters of one or more of decoding chains 30. Additionally, or alternatively, conductor 28 may:

enable a decoding chain set 24 corresponding to a transducer 14 when the corresponding transducer 14 is connected to system 20;

disable a decoding chain set 24 corresponding to a transducer 14 when the corresponding transducer 14 is disconnected from system 20.

Non-limiting example methods which may be performed by auditor 26 and/or conductor 28 will now be described in more detail.

Figure 3A:
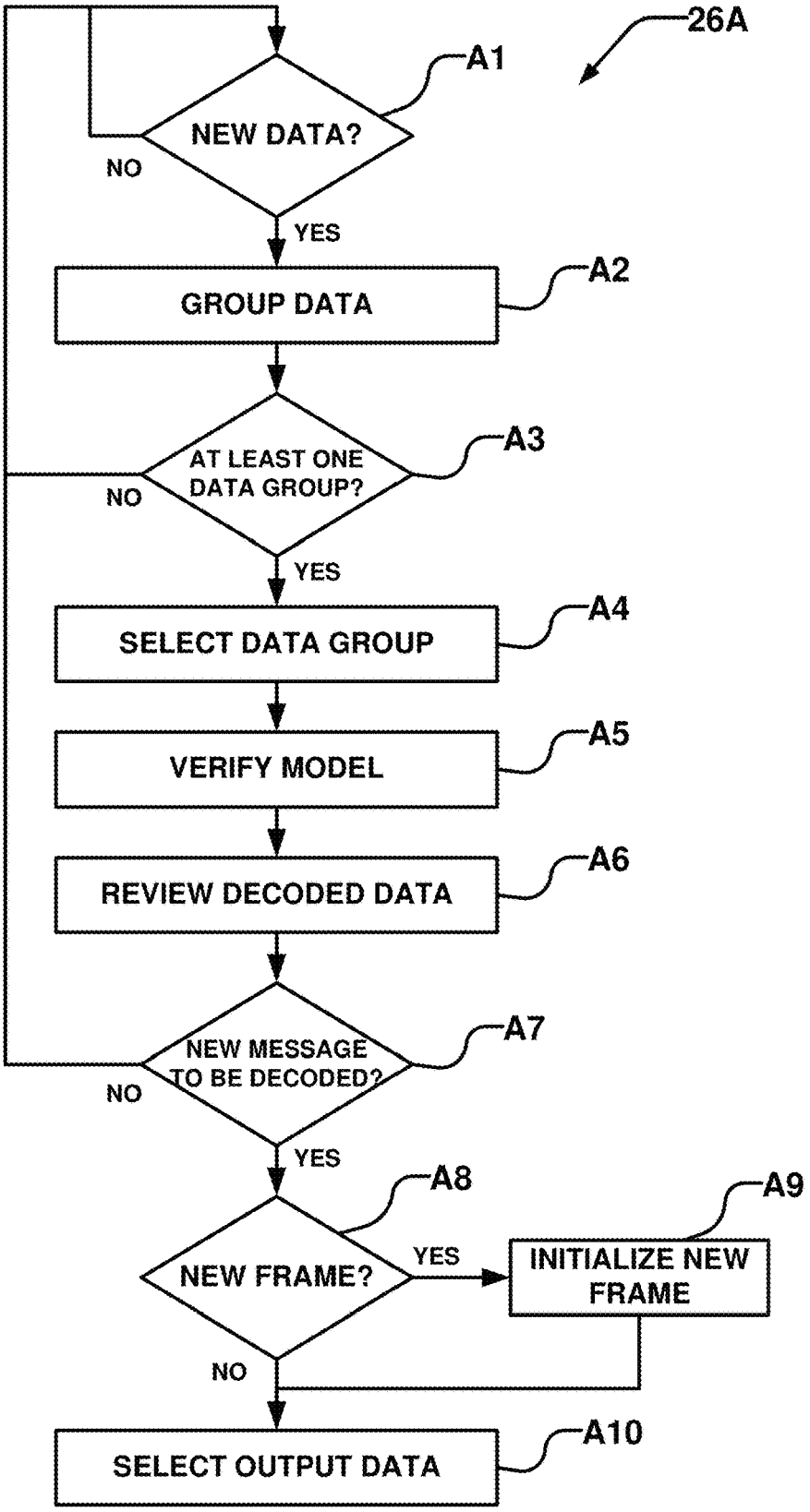
FIGS. 3A-3D are flow charts of methods according to example embodiments of the invention.

FIG. 3A is a block diagram which illustrates an example method 26A for verifying data decoded by decoders 34 of decoding chains 30. Method 26A may, for example, be performed by auditor 26.

Data transmitted by MP telemetry is generally sent in frames. Each frame may have a specified format. For example, a frame typically includes a header which is a pattern of mud pulses that symbolizes the start of a frame. Following the header, the frame typically includes a frame ID. The frame ID specifies the type of frame that that frame is. There may be several different types of frames that are identified by different frame IDs. Different types of frames may transmit different numbers of data messages, different sequences of data messages and/or the like. The frame ID is generally followed by one or more data values. The individual data values may be called "messages". The individual values may specify drilling parameters such as azimuth, inclination, total magnetic field, total gravitational field, dip, gravity tool face, magnetic tool face, raw gravitation readings, raw magnetic readings, etc.

A frame may also typically include one or more error correction/error check codes. In some embodiments a frame includes one error correction/error check code per data message included in the frame.

In block A1, method 26A waits for new data to be decoded by a decoding chain 30. When new data has been decoded, method 26A may proceed to block A2. In some embodiments block A1 may be skipped. For example, a decoding chain 30 may initiate method 26A upon decoding data and method 26A may then proceed directly to block A2.

Decoded data is sorted in block A2. For example, the decoded data from a plurality of active decoding chains 34 may be sorted into a plurality of groups. The groups may be based on one or more characteristics of the decoded data such as type of data, header start time, header type, etc. For two decoded data items (e.g. decoded data from two frames) to be grouped together into the same group, the two decoded data items need to share at least one characteristic. In some embodiments two decoded data items are grouped together into the same group if they are of the same type (e.g. the same frame type for example as indicated by the same frame ID) and the header of each of the two decoded data items commenced within a threshold time (e.g. a time corresponding to at most 3 symbols). The same MP signals may arrive at different transducers 14 at different times and therefore a frame of data decoded by different decoding chains 30 may be received at slightly different times.

In block A3 method 26A verifies that the sorting in block A2 has resulted in at least one group comprising data frames that have been decoded. If not, method 26A returns to block A1 (or method 26A is terminated). If there is at least one group comprising data frames that have been decoded, method 26A proceeds to block A4.

Block A4 selects the group with the largest amount of data frames that have been decoded. Once the group with the largest amount of data frames that have been decoded is selected, block A4 may check whether the selected group has a sufficient number of data frames that have been decoded to determine whether the data members are accurate or inaccurate "garbage" values that may be discarded.

In some embodiments a confidence level associated with the selected group is determined by summing confidence levels of the data messages within the selected group (e.g. as described elsewhere herein).

In some embodiments block A4 may compare the number of data frames that have been decoded in the group against a threshold value. For example, block A4 may require that the selected group comprises a number of data frames that have been decoded that is at least 50% of the data frames that have been decoded from all decoders (across all transducers 14). Without being bound to a particular theory of operation, the inventors have discovered that, for headers, if at least 50% of the decoders agree on characteristics of the decoded data (e.g. timing of pulses and the type of frame), then most likely the decoded data is accurate. However, such 50% threshold is only an example and may be varied based on application. In some cases the threshold in the range of about 20%-30%. In some cases the threshold is in the range of about 65%-75%.

As described elsewhere herein any one of decoding chains 30 may abandon a frame that is currently being decoded and start decoding a new frame. Block A5 of method 26A verifies that the data being currently verified by auditor 26 and the data already verified by auditor 26 are in agreement. If the data being currently verified and the data already verified are not in agreement, then the current data in auditor 26 may be deleted and a new data model (e.g. an estimated of what data is expected) may be created in auditor 26.

In block A5 the decoded data member from the selected group (i.e. the group with the largest amount of decoded data members) is set as the current data model. The current data model may be compared against the existing data model (or the new data model) stored in auditor 26 (e.g. the model from the previous cycle). In order for the current data model and the existing data model to be in agreement, both data models need to have the same characteristics (e.g. the same type of frame and the frame must start at the same time, etc.). If both data models are in agreement then block A5 retrieves the last audited data member or message. If the current data model is different from the existing data model, the current data model replaces the existing data model. Block A5 may also keep track of the number of decoded data members or messages that have been processed by auditor 26.

In block A6 the decoded data is reviewed (e.g. by auditor 26). The decoded data may, for example, only be reviewed for the decoding chains 30 (or decoders 34) of the selected group. Block A6 may find the data that has been commonly decoded amongst the decoding chains 30 (or decoders 34) of the selected group. In some cases the common decoded data corresponds to the least amount of decoded messages (i.e. the number of messages that has been decoded by all of the decoding chains 30 of the group since one or more of the decoding chains 30 may decode data at different rates). If for example a first decoding chain 30 in the group decoded 3 messages, a second decoding chain 30 in the group decoded 2 messages and a third decoding chain 30 in the group decoded 4 messages the least amount of decoded messages would be 2. It is typically advantageous to ascertain the common data since different decoding chains 30 (or decoders 34) may process the received transducer signal data differently (e.g. different filtering, different decoding chains 30 (or decoders 34) receive transducer signal data at different times due to positioning of transducers 14, etc.).

Block A7 determines whether there are any new messages to be audited (e.g. is the least amount of decoded messages greater than the number of messages already decoded?). If not, method 26A may terminate or may return to block A1. If there are new messages to be audited method 26A may proceed to block A8.

Block A8 determines whether a new frame needs to be initialized. A new frame may need to be initialized for example if the current data model did not match the existing data model as described above. If so, a new frame is initialized in block A9. Otherwise method 26A proceeds to block A10.

Block A10 selects which one of the decoded data messages is to be output as the decoded data (e.g. to a user). For example, block A10 may select the most frequently occurring decoded data message as the decoded data message to be output as described elsewhere herein. As another example, block A10 may compare header correlations (e.g. how closely the header corresponds to an expected header) of the decoded data messages and output the decoded data message with the highest header correlation as the decoded data. In some embodiments a copy of the header with the highest header correlation may be stored and used in subsequent iterations of method 26A against which new headers data will be compared against. In some embodiments the header data may be visually output to a user (e.g. a graphical representation, etc.).

Figure 3B:
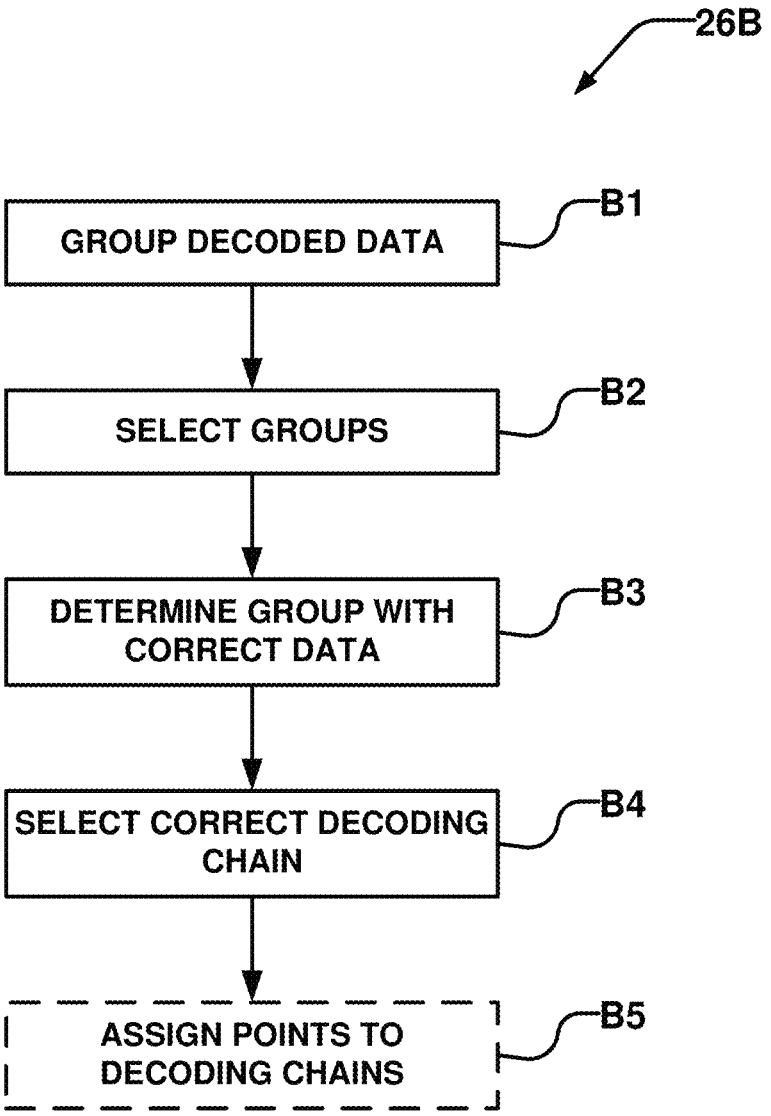

FIG. 3B illustrates an example method 26B for selecting which of the decoded data messages to be output which may be performed by block A10 of method 26A.

In block B1 all of the decoded data messages (and their corresponding decoding chains 30/decoders 34) are grouped based on output. For example, all decoding chains 30 (or decoders 34) which have decoded the same value may be grouped together. A cumulative confidence may be determined for a group (e.g. a sum of all of the confidence values of each decoding chain 30 (or decoder 34) in the group). In some cases a peak confidence may be determined for a group (e.g. the highest confidence value of a single decoding chain 30 (or decoder 34) in the group).

In block B2 the group with the highest cumulative confidence is selected (i.e. group G1). Block B2 also selects the group with the highest peak confidence (i.e. group G2).

In block B3 one of groups G1 and G2 is selected as the group corresponding to the most likely to be correct data. If groups G1 and G2 are the same group, then that group corresponds to the correct data. If the peak confidence of group G2 is greater than the peak confidence of group G1 multiplied by a scaling factor then group G2 corresponds to the correct data. Otherwise group G1 corresponds to the correct data. In some embodiments the scaling factor is in a range from about 1.15 to about 1.3. In some embodiments the scaling factor is about 1.2.

In block B4 a decoding chain 30 (or decoder 34) is selected as the decoding chain 30 (or decoder 34) which will output the decoded data (e.g. to a user). For example, within the group selected by block B3 (i.e. either group G1 or group G2), the decoding chain 30 (or decoder 34) with peak decoding confidence is selected to output the decoded data. In some embodiments the decoded data, the decoding chain 30 (or decoder 34) and/or parameters of decoding chain 30 (or decoder 34) may be stored (e.g. by auditor 26) to avoid repeating the auditing process for the same data in the future. Additionally, or alternatively, the decoded data may be stored to avoid outputting the same data repeatedly.

In block B5, decoding chains 30 may optionally be awarded "points". Such points may be used (e.g. by conductor 28) to determine which decoding chains 30 to keep and which decoding chains 30 to remove. For example, each decoding chain 30 in the group selected by block B3 (e.g. group G1 or group G2) may get one point. The decoding chain 30 in the group with peak confidence may get one additional point. If there is only one decoding chain 30 in the group, than the additional point may be assigned to the sole decoding chain 30 but the additional point may be referred to as a unique decoding point.

In some embodiments auditor 26 generates a visual representation for a user which easily identifies decoding quality of system 20, decoding chain sets 24 and/or individual decoding chains 30. The visual representation may be displayed to the user via a graphical user interface (GUI).

Figure 3C:
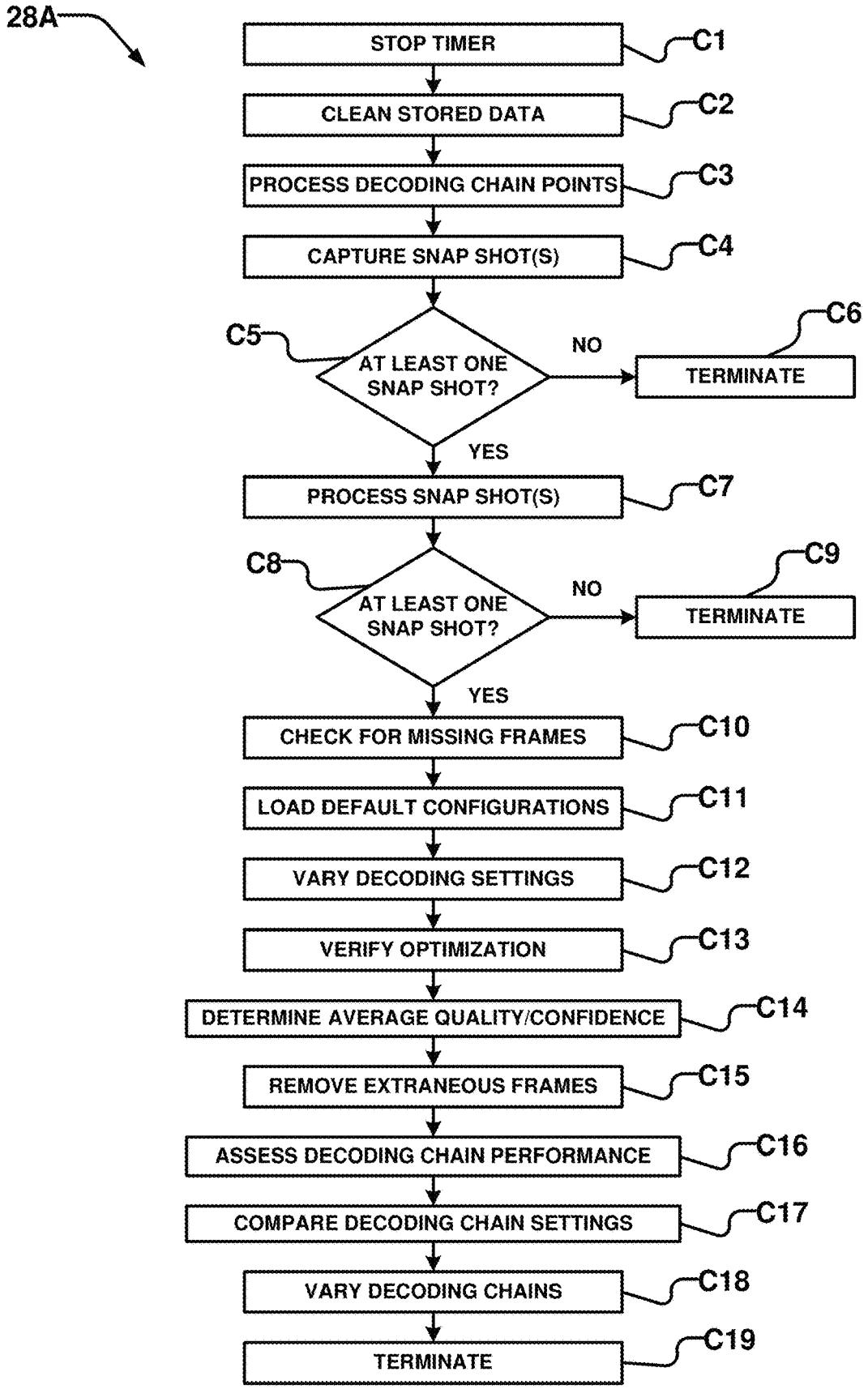

FIG. 3C is a block diagram illustrating an example method 28A for verifying performance of functional units of system 20. Method 28A may, for example, be performed by conductor 28.

In block C1, method 28A is triggered. For example, a timer that activates performance of method 28A is stopped (e.g. method 28A may be run periodically such as every hour, every 15 minutes, every 2 hours, etc.).

In block C2 previous data which may be stored (e.g. in conductor 28) is cleaned up. For example, previous stored decoded data is removed except for data stored within a threshold amount of time prior to method 28A being initiated (e.g. within 10 minutes, 15 minutes, 30 minutes, etc.). In some embodiments decoded data is stored (e.g. in conductor 28) every time auditor 26 verifies decoded data as correct. Additionally, information (e.g. time, duration, etc.) about events such as a flow-off period may also be stored.

As described elsewhere herein points may be assigned to decoding chains 30 by auditor 26. Each of the assigned points may be time stamped. Block C3 optionally removes any assigned points that have been aged (i.e. are older than the threshold amount of time). Block C3 may determine how many points within the threshold amount of time each decoding chain 30 has. In some embodiments block C3 sums all of the points within the threshold amount of time (and optionally stores the determined sum) for each decoding chain 30.

Block C4 determines an analytical snapshot of characteristics of a drilling operation for a time-period under assessment. Characteristics which may be captured and/or retrieved include:

- a history of drilling fluid flow;
- recently decoded data (e.g. as determined by auditor 26);
- recent visual history (e.g. as determined by auditor 26);
- a history of raw data from transducers 14;
- a history of channel status (e.g. per transducer 14);
- a history of pump noise filter (PNF) data (e.g. per transducer 14);
- a total number of decoding points (per decoder) (e.g. points awarded for correct decoding as described elsewhere herein);
- etc.

Block C5 determines whether at least one analytical snap shot was captured. If not, block C6 may terminate method 28A and re-enables the timer which initiates method 28A. Otherwise method 28A proceeds to block C7.

Block C7 determines whether for each snap shot (e.g. corresponding to a transducer 14) the corresponding transducer 14 was connected for a sufficiently long enough time that the snap shot can hold at least one frame. Any snap shot where a transducer 14 was not connected for a sufficiently long enough period of time for the snap shot to potentially hold at least one frame is removed.

Block C8 determines whether there is at least one snap shot remaining. If not, block C9 may terminate method 28A and re-enables the timer which initiates method 28A. Otherwise method 28A proceeds to block C10.

Block C10 checks for any missing frames. Preferably, block C10 scans the visual history. However block C10 may alternatively scan the decoded data history (e.g. within the threshold amount of time). Block C10 scans the data and checks whether there are any significant gaps in the data. If a gap is detected, block C10 verifies whether the gap was during a drilling fluid flow OFF period (ok for there to be a gap) or whether the gap was during a drilling fluid flow ON period (not ok for there to be a gap). If the gap is for a length of time that is equal to a length of a frame, the gap may indicate that a frame was missed. If no gaps are detected an average decoding confidence of the decoded data history may be determined (e.g. an average of the confidence values of each frame being assessed). If the average confidence is greater than a threshold confidence and there were no gaps or suspected missing frames, method 28A may terminate and the timer which initiates method 28A may be re-enabled. In such cases method 28A typically does not proceed since it is unlikely that decoding quality could be improved.

Alternatively, or additionally, if no gaps are detected a metric indicating how many messages were successfully decoded relative to the number of total messages (or how many messages were unsuccessfully decoded relative to the number of total messages) may be determined. In some embodiments the metric is determined by dividing the number of successfully decoded messages by the total number of messages. In some embodiments the metric is determined by dividing the number of unsuccessfully decoded messages by the total number of messages. The total number of messages may, for example, be obtained from a history of recent messages from auditor 26 (e.g. messages decoded in the preceding hour, hour and a half, two hours, etc.). Based on a comparison of the metric to a threshold criteria, method 28A may terminate and the timer which initiates method 28A may be re-enabled. For example, if the metric corresponds to the number of successfully decoded messages relative to the total number of messages and the metric is higher than or equal to a threshold value (e.g. 90%, 95%, 99%, etc.) then system 20 may be considered to be performing well and method 28A may terminate and the timer which initiates method 28A may be re-enabled.

In some embodiments if auditor 26 is disabled then conductor 28 is also disabled.

Default configurations for decoding chains 30 (e.g. initial settings for decoding chains 30) may be loaded in block C11. In currently preferred embodiments 4 default configurations are typically loaded.

In block C12 filter settings for individual decoding chains 30 are varied in an attempt to improve decoding quality. In some cases block C12 varies one or both of the settings of low pass filter 31 and high pass filter 32 of an individual decoding chain 30. If the variation improves decoding quality, the varied settings may be stored. In some cases block C12 optimizes one or both of the settings of low pass filter 31 and the settings of high pass filter 32 to maximize the quality of raw data and/or the data after a pump noise filter is applied for accurately detecting mud pulses by processing the data. In some cases block C12 varies filter settings of one decoding chain 30 at a time. In some cases block C12 varies filter settings of plural decoding chains 30 at a time.

In some embodiments block C12 is performed for each default configuration loaded in block C11 per snapshot.

Once optimized settings of low pass filter 31 and/or high pass filter 32 are determined (e.g. settings which maximize quality of the filtered signal for accurately detecting mud pulses) the raw data or data after the pump noise filter is applied may be filtered with such low pass filter 31 and high pass filter 32.

Block C13 verifies that following the optimization of block C12 there are no decoding chains 30 with substantially similar settings (e.g. settings which are similar within a threshold amount). If two decoding chains 30 have substantially similar settings, block C13 keeps the decoding chain 30 with the higher mud pulse quality (e.g. higher header correlation, higher confidence, etc.) and deletes the other decoding chain 30. Higher mud pulse quality may, for example, be determined with a mud pulse analyzer described elsewhere herein.

In block C14 an average mud pulse quality or confidence for each decoding chain 30 is determined. If the average quality or confidence is below a threshold amount (e.g. 40%, 30-50%, etc.) for a decoding chain 30, that decoding chain 30 may be removed.

In block C15 extraneous frames such as STATUS frames are removed from the recently decoded data. Typically STATUS frames are rare, are short, do not contain many messages, etc. STATUS frames typically have a small overall impact on decoding quality.

Block C16 determines decoding ability of individual decoding chains 30. Decoding ability may be determined by testing the ability of an individual decoding chain 30 to perform edge detection for headers and edge detection for symbols. Decoding ability may be tested for each varied setting (e.g. edge detection for headers (ON or OFF), edge detection for symbols (ON or OFF)). The varied settings are tested via recently decoded filtered data which may be used as a reference (e.g. reference data may be retrieved from auditor 26 and may correspond to previously decoded data). Block C16 may award a score (e.g. a number of points) for correct decoding. In some cases extra points are awarded for settings which correctly decode data when the reference data did not pass an error check (e.g. CRC or parity bit error checks). Block C16 selects the settings for an individual decoding chain 30 which had the highest number of points. Block C16 may be performed per data snapshot for each combination of settings for an individual decoding chain 30.

In some embodiments a score awarded to a decoding chain 30 or decoder 34 of a decoding chain 30 is stored. The score may, for example, be stored in a data store of decoding chain 30, a data store of decoder 34 and/or the like. In some embodiments awarded scores (e.g. the stored points) may be compared with scores awarded to new potential decoding chains 30. Such comparison may, for example, be used to determined which decoding chains 30 to keep and which decoding chains 30 to remove (e.g. by conductor 28).

Block C16 may be performed for each modified configuration (e.g. each configuration that exists after block C13) per snapshot.

Block C17 compares any new decoding chain 30 settings to existing decoding chain 30 settings for the decoding chains 30 corresponding to a particular transducer 14 (each snapshot may correspond to a different transducer 14). If the settings of a new decoding chain 30 are similar to the settings of an existing decoding chain 30 the new decoding chain 30 may be removed (e.g. to avoid duplication of processing).

Settings of two decoding chains 30 may be similar if edge detection settings are the same and filter settings (e.g. of low pass filter 31 and/or high pass filter 32) are similar within a threshold amount.

Block C18 adjusts the decoding chains 30 of decoding system 20 accordingly. For example, if decoding system 20 is to have a threshold number of decoding chains 30 (e.g. 4 per transducer 14), block C18 may rank the new and existing decoding chains 30. Decoding chains 30 may be ranked based on the points assigned in block C16. Decoding chains 30 of decoding system 20 which are not within the threshold number (i.e. are ranked lower) may be removed. New decoding chains 30 (i.e. with new settings) which are within the threshold number may be added to decoding system 20.

Block C18 may be performed toward the end of a frame or during a flow OFF event. Removing a large number of decoding chains 30 and/or adding a large number of decoding chains 30 may impact performance of conductor 28 and/or auditor 26. For example, if there are many decoding chains 30 which are idle, auditor 26 may not be able to create a model. Performing block C18 toward the end of a frame or during a flow OFF event may advantageously avoid having many idle decoding chains 30.

In block C19 method 28A terminates and the timer which initiates method 28A is re-enabled.

Figure 4:
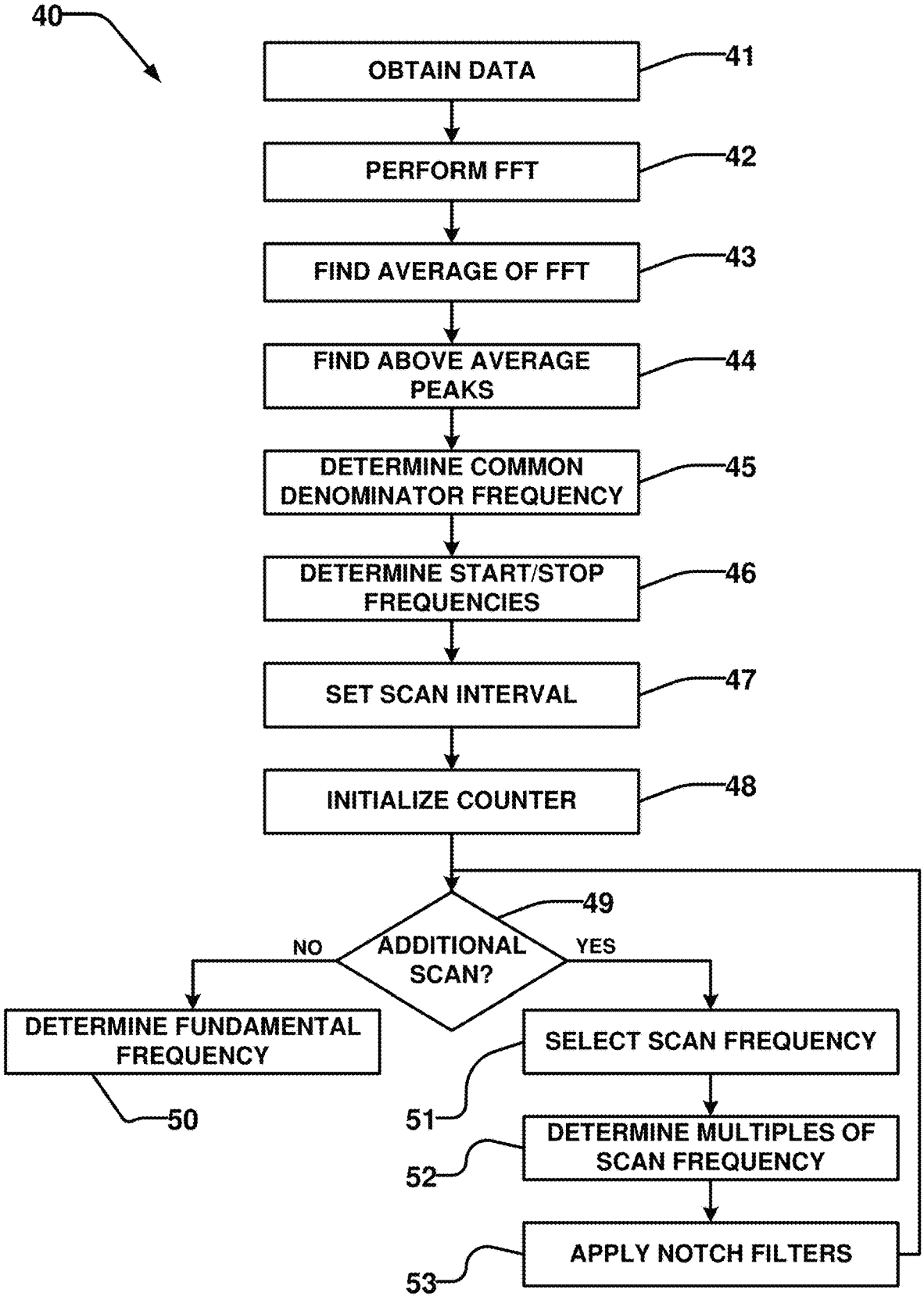
FIG. 4 is a block diagram of a method of removing pump noise from a sensed data signal according to an example embodiment of the invention.

FIG. 4 is a block diagram showing an example method 40 which may be used to tune the frequencies of the notch filters of pump noise filter 35. An objective of method 40 is to optimize tuning of the notch filters for removing pump noise from transducer output data.

In order to most effectively remove pump noise it may be necessary to tune the fundamental frequency of pump noise filter to within $10^{-3}$ Hz or closer to an actual fundamental frequency of the pump noise. The fundamental frequency for pump noise filter 35 may be tuned by incrementally varying the fundamental frequency and assessing at which incremental value for the fundamental frequency pump noise is reduced the most. In some embodiments center frequencies of notch filters in pump noise filter 35 are optimized to an accuracy of ±0.001 Hz or 0.0001 Hz or 0.00001 Hz or even greater accuracy.

In block 41 method 40 obtains a set amount of transducer output data (e.g. about 40 seconds of data at a suitable sampling rate). In some embodiments about 60 seconds of transducer output data is acquired. In some embodiments about 30 seconds of transducer output data is acquired.

In block 42 a fast Fourier transform (FFT) is performed on the data acquired in block 41. Block 42 may record an FFT power per frequency. An average power value (per frequency) may be determined in block 43.

In block 44 peaks which are above the average FFT value determined in block 43 are found. Corresponding FFT bin numbers (e.g. frequencies) of the peaks ("peak frequencies") may be recorded.

In block 45 a common denominator fundamental frequency (F1) of the recorded peak frequencies is determined. Each fundamental frequency that is found by method 40 may be recorded and compared with previous results (e.g. new value compared with older values and based at least in part on that comparison an output value is determined).

Start and/or stop scan frequencies are determined in block 46. A start scan frequency may be determined as:

$$\text{start scan frequency} = F1 - \frac{FFT \text{ bin width}}{2}.$$

A stop scan frequency may be determined as:

$$\text{stop scan frequency} = F1 + \frac{FFT \text{ bin width}}{2}.$$

In block 47 K distinct frequencies between the start scan frequency and the stop scan frequency are set. An interval between neighboring ones of the distinct frequencies may, for example, be determined as follows:

$$F_{scanM}=(\text{stop scan frequency}-\text{start scan frequency})/K.$$

In block 48 a counter M is initialized to 0.

Block 49 determines whether additional scans are to be taken (e.g. whether a value of counter M is less than K).

Blocks 51-53 are repeated for each of the scan frequencies. In each repetition of blocks 51-53 notch filters of pump noise filter 35 are set based on the current scan frequency to remove pump noise. In block 51 the next scan frequency is selected. In block 52 integer multiples of the scan frequency are determined. In block 53, for each of the integer multiples, the notch filter is applied and a sum of power of the FFT (a sum of power of the peaks above the average) is recorded.

In block 50 the scan frequency for which the sum of power of the FFT is smallest is selected as the fundamental frequency for pump noise filter 35 (i.e. this corresponds to a fundamental frequency of the pump noise). Multiples of the fundamental frequency may additionally be used as additional notch frequencies to remove remaining pump noise.

In some embodiments, optimization to determine an exact value for a fundamental frequency that will most effectively remove pump noise is determined in a process that involves plural stages. In a first stage, a coarse search may be conducted for the optimum fundamental frequency to use as a basis for frequencies of notch filters in pump noise filter 35. Each subsequent stage may optimize fundamental frequency in a relatively small range around the best value for the fundamental frequency found in the previous stage.

For example a first stage may approximately determine a fundamental frequency of a pump to within ±0.5 Hz. The approximate fundamental frequency may be determined by measurement or by knowledge of the operating characteristics of the pump. A second stage may conduct a search for a better value for the fundamental frequency in a neighborhood around the fundamental frequency identified in the first stage using scan frequencies separated by 0.01 Hz, a third stage may further refine the best value for the fundamental frequency determined by the second stage by conducting a search in the neighbourhood of the best value from the second stage with scan frequencies separated by a smaller increment (e.g. 0.001 Hz).

In an example embodiment an initial estimate of a fundamental frequency of pump noise (e.g. determined as described herein) is subdivided into a plurality of bins (e.g. 10 bins each having a bandwidth of 0.01 Hz). For example, if the fundamental frequency corresponding to the pump noise is 3 Hz, 10 bins (e.g. from 2.95-3.05 Hz may be set). For each of these bins, an instance of pump noise filter 35 in which notch filters have frequencies based on the bin frequency may be launched. The bin for which the pump noise is reduced the most may be selected for further tuning. This subdivision may be referred to as "gross tuning". Such gross tuning may be performed as part of blocks 49 and 51-53 of example method 40 described elsewhere herein.

Once the bin for which the pump noise is reduced the most is determined during the gross tuning method, further tuning of the frequency of the pump noise filter may be performed (this may be referred to as "fine tuning").

In currently preferred embodiments fine tuning is performed by step-wise variation of the fundamental frequency determined by the gross tuning. For example, if the bin which reduced the pump noise the most corresponds to 3.04 Hz, a set of scan frequencies separated from one another by a smaller increment (e.g. 0.001 Hz) in a range surrounding 3.04 Hz may be used to explore whether a better value can be found for the fundamental frequency. In such example case, the scan frequencies may, for example, be in the range of 3.035 Hz to 3.045 Hz.

To reduce the number of steps required to find a best one of the scan frequencies, a search for the best scan frequency may start by determining whether better values for the fundamental frequency are obtained by increasing or decreasing the fundamental frequency from the previous best value (in this example 3.04 Hz). Depending on what frequency variation (e.g. step fundamental frequency up or step fundamental frequency down) is most effective at reducing pump noise, the fine tuning may continue changing the value of the fundamental frequency in the selected direction. For example, if an incremental decrease in the value for the fundamental frequency (e.g. from 3.04 to 3.039) is found to reduce pump noise more than an incremental increase in the value of the fundamental frequency (e.g. from 3.04 to 3.041) then the fine tuning may continue by incrementally decreasing the value of the fundamental frequency. Conversely, if incrementally increasing the value of the fundamental frequency caused a greater reduction of pump noise then the fine tuning may continue by incrementally increasing the value of the fundamental frequency.

If the frequency found by the gross tuning (in this example 3.04 Hz) removed more pump noise than any of the scan frequencies tried in the fine tuning (i.e. had better results than the incremental step up and step down) then the fine tuning may proceed with a reduced increment size (e.g. 0.0001 Hz instead of 0.001 Hz). This may be repeated until a threshold step size has been reached (i.e. the step size has become sufficiently small). In some embodiments the threshold step size is set by a user.

The frequency increments may be the same for each stage of the search for a best value of the fundamental frequency but this is not necessary in all embodiments.

In some embodiments fine tuning is performed by further sub dividing the bin found by the gross tuning into a plurality of sub-bins to further tune the frequency of the pump noise. For example, if the bin which reduced the pump noise the most corresponds to 3.04 Hz, that bin may be subdivided into a plurality of sub-bins (e.g. 10 bins in 0.001 Hz increments from 3.035 Hz to 3.045 Hz). The pump noise filter may be launched for each one of the sub-bins. The frequency corresponding to the sub-bin for which the pump noise is reduced the most may be selected as the value for the fundamental frequency of the pump noise. Further tuning may be performed by repeating the frequency subdivision until a desired frequency resolution is achieved.

In some embodiments a pump noise filter 35 associated with each transducer 14 is individually tuned.

Method 40 may be repeated (e.g. periodically and/or whenever a level of pump noise detected after a pump noise filter 35 exceeds a threshold value) to process new sensed data and to stay within an acceptable variation of the fundamental frequency that was found by method 40. In some embodiments method 40 is performed every 2 seconds. In some embodiments method 40 is performed more frequently or less frequently than that. In some embodiments two different methods may be performed to stay within an acceptable variation of the fundamental frequency (e.g. a gross tuning method which is performed less frequently and a fine tuning method which is performed more frequently). In one example non-limiting case, the gross tuning method is performed about every 20 seconds while the fine tuning method is performed about every 2 seconds.

In some cases block 45 may produce several potential fundamental frequencies. If so, blocks 46 to 50 may be performed for each potential fundamental frequency found in block 45. Method 40 may fine tune each of the fundamental frequencies. Method 40 may then select one of the fundamental frequencies.

In some cases method 40 avoids selecting a frequency that is % of the fundamental frequency (avoids affecting frequencies which do not need to be affected). The selected fundamental frequency may be stored in memory (e.g. a recent history). In some embodiments the selected fundamental frequency is compared against other previous fundamental frequencies recently selected. In some embodiments method 40 selects the most common fundamental frequency from the comparison and fine tunes that frequency further to improve accuracy.

If a newly determined fundamental frequency varies from the previously found fundamental frequencies by more than a threshold amount (e.g. 1%, 5%, 10%, 15%, etc.) or a fixed amount (e.g. more than a width of a bin used for the gross tuning or fine tuning described elsewhere herein) the existing notch filters may be discarded and a new set of notch filters may be generated. If the newly determined fundamental frequency does not vary from the previously found fundamental frequencies by more than the threshold amount the existing notch filters may be adjusted to match the newly determined frequency.

Figure 5A:
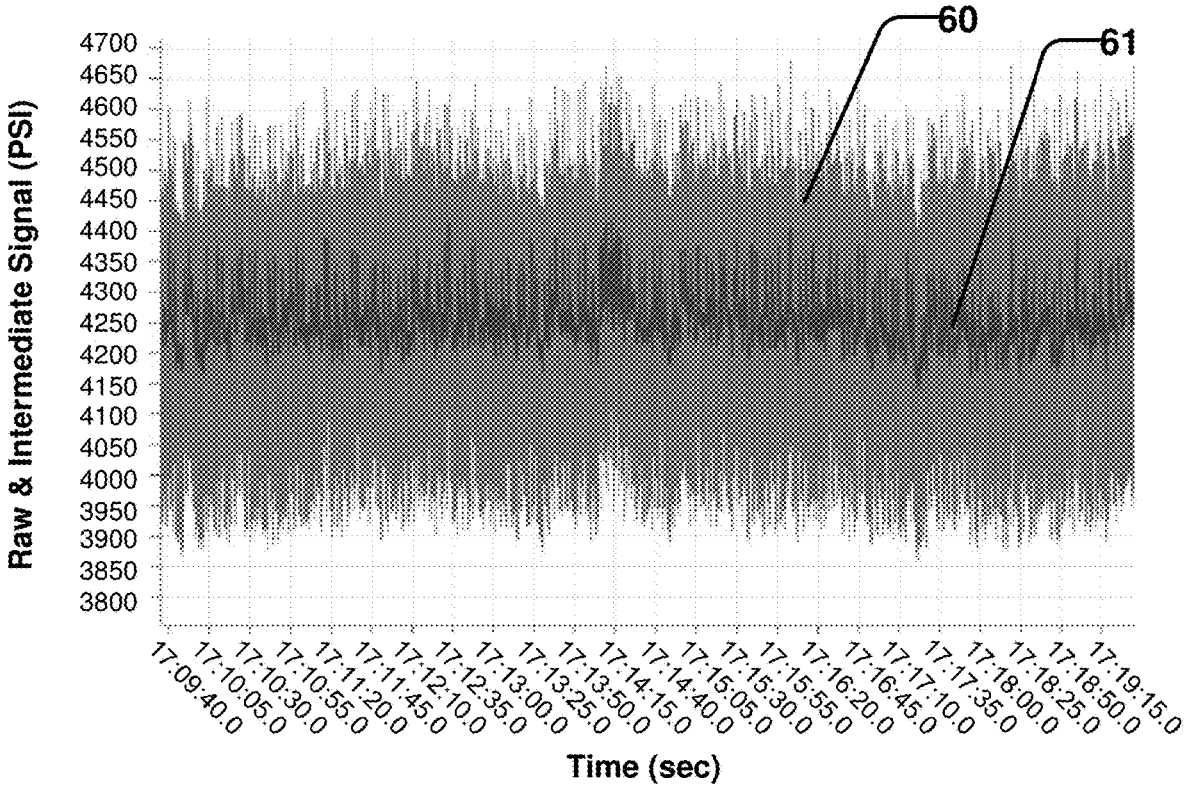
FIG. 5A is a graphical illustration of an example sensed data signal.

FIG. 5A is a graphical illustration of example transducer output data from a transducer 14. Curve 60 is unfiltered example transducer output data. Curve 61 is pump noise filtered transducer output data which has been processed as described herein to remove pump noise.

Figure 5B:
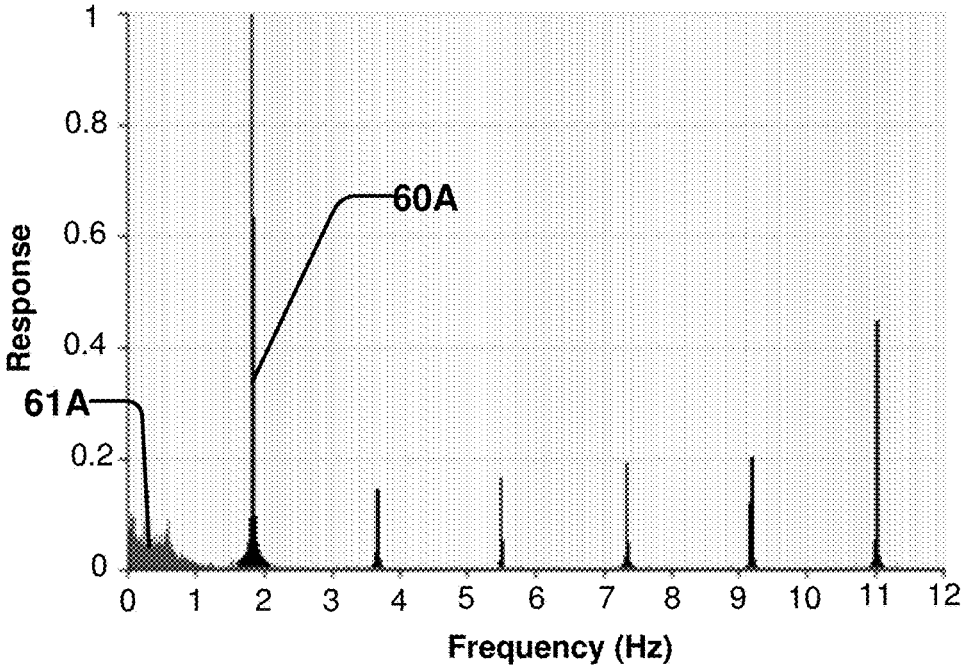
FIG. 5B is a graphical illustration of a frequency spectrum of the sensed data signal of FIG. 5A.

FIG. 5B illustrates the corresponding frequency spectrum of the transducer output data shown in FIG. 5A. Curve 60A is the frequency spectrum of unfiltered data 60. Curve 61A is the frequency spectrum of filtered data 61.

Usually MP telemetry data is transmitted in a structure. We refer to that structure as a frame, each frame may begin with a header that comprises a distinctive series of pulses that indicates the start of the frame and also establishes a timing reference for the frame. The header may be followed by a series of pulses that provides a data payload for the frame.

The header is generally chosen to be distinguishable, reasonably long and reasonably unique. The header typically sets a timing for decoding the remainder of the MP telemetry data frame.

The pulses of the data payload may encode a set of values (e.g. readings from downhole sensors). The data payload may include error checking and error correcting data such as cyclic redundancy check (CRC) data. To decode MP telemetry data it is therefore usually necessary to monitor for a frame header which indicates the start of a frame, subsequently detect and determine symbols and the characteristics of the symbol pulses that make up the data payload and then process the detected pulses to recover the transmitted data. Sometimes different types of frames are used to convey different types of data. In such cases different frame IDs may signify different types of frames. The significance of digital bits in the data payload may be different depending on the type of frame. The frame ID may be processed to determine what type of frame is being received. This knowledge may be used to recover the data from the data payload. A typical transmission sequence comprises transmitting the header, followed by the frame ID followed by the data message to be transmitted in the frame.

Decoder 34 may comprise a data analyzer which analyzes the filtered data. In some embodiments the data analyzer comprises a machine learning model which has been trained to identify characteristics (e.g. pulse amplitude, pulse width, pulse shape, etc.) that correspond to pulses that encode MP telemetry data. Based on the identified characteristics of specific mud pulse shapes corresponding to the filtered data of the particular decoding chain 30, data analyzer may process the filtered data to identify mud pulses and/or specific sequences of mud pulses and based on the identified mud pulses and/or mud pulse sequences determine quality of mud pulses, shapes of mud pulses, etc. of the MP telemetry data. Decoder 34 may choose whether to use data (e.g. mud pulse shape, mud pulse quality, etc.) provided by the data analyzer. In some embodiments a user determines whether decoder 34 uses data from the data analyzer, what data is used from the data analyzer, etc.

Figure 3D:
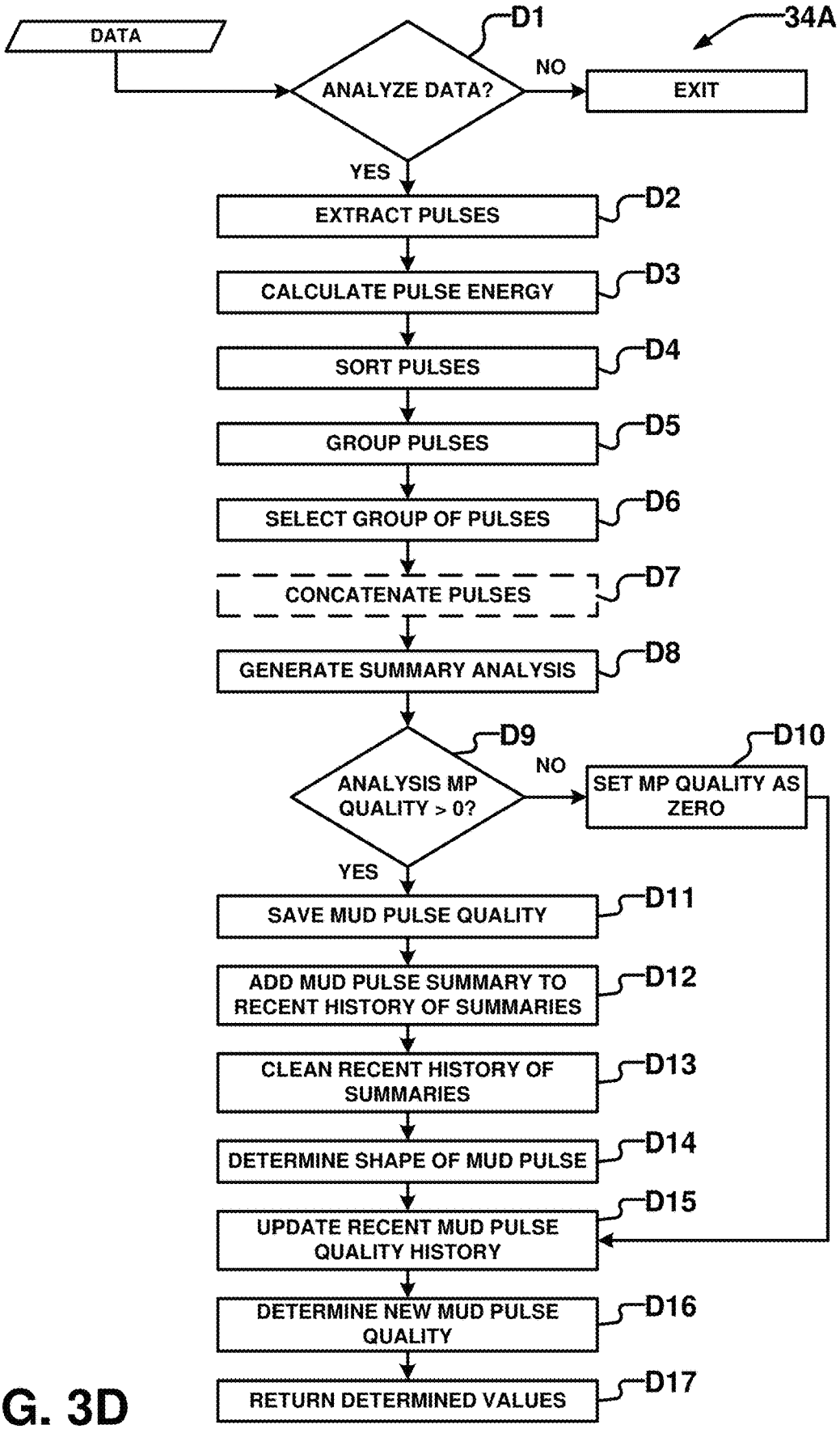

FIG. 3D illustrates an example method 34A for analyzing mud pulse data to determine quality of mud pulses, shapes of mud pulses, etc. of the mud pulse telemetry data.

Block D1 receives data from decoder 34 (e.g. data is typically already filtered and/or clipped) and determines whether it is time to analyze the received data. For example, block D1 may count each received data sample. When a threshold count is reached, block D1 may determine that it is time to analyze the data and proceed to block D2. Received data samples may be stored until it is time to analyze the data.

Block D2 extracts pulses from the data.

An energy of each of the extracted pulses is determined in block D3. The energy of a pulse may, for example, be determined by determining the area under the pulse.

The pulses may be sorted in block D4. For example, the pulses may be sorted based on energy levels (e.g. from larger energy to smaller energy). In some cases different types of pulses have different energy levels (e.g. mud pulses vs. pulses other than mud pulses) and therefore the different types of pulses may be sorted based on energy levels.

In block D5 the sorted pulses are grouped or binned together. The different groups or bins may correspond to different energy levels (e.g. high energy, medium energy and small energy groups or bins).

The group or bin which has the highest likelihood of corresponding to mud pulses (e.g. pulses generated by a mud pulse transmitter) is selected in block D6.

If, for example, the amount of data captured and the frequency at which mud pulses are expected to appear at transducers 14 is known, an expected number of mud pulses that should be present in a set of data samples of a particular size can be determined. Typically the expected number of mud pulses is about tens of mud pulses (e.g. 20, 30, 40, 50, etc. mud pulses). In some embodiments the group or bin which has a number of pulses that most closely matches the expected number of mud pulses is selected as the group or bin which has the highest likelihood of corresponding to mud pulses.

In some embodiments block D6 begins with the group or bin corresponding to the largest energy pulses and determines whether that group has a number of pulses that is close to the expected number of pulses. If that is not the case, block D6 may move onto the next group or bin. The group or bin with the largest energy pulses may be chosen first since such pulses are more likely to be correlated by decoder 34 than lower energy pulses.

In some embodiments the number of pulses in a group or bin is compared against the expected number of pulses multiplied by a scaling factor that accounts for erroneous pulses (e.g. noise that resembles pulses).

In block D7 some pulses within the selected group may be concatenated together as described elsewhere herein.

In block D8 a summary of the analysis is generated. The summary may, for example, determine one or more of the following:

- total pulses in the selected group or bin;
- total pulses in the selected group or bin after concatenation of some pulses;
- the expected number of pulses in the data;
- an allowed error in the number of detected pulses in the data;
- average pulse shape;
- mud pulse quality;
- etc.

Mud pulse quality may, for example, be determined as follows:

$$\text{mud pulse quality} = \left(1 - \frac{|N_{MP} - AN_{MP}|}{EN_{MP}}\right) * 100$$

where $N_{MP}$ is the expected number of pulses in the data, $AN_{MP}$ is the actual number of pulses in the data (after concatenation if concatenation is performed) and $EN_{MP}$ is the allowed error in the number of detected pulses in the data.

Block D9 determines whether a determined mud pulse quality value is greater than zero. If not, the mud pulse quality value is set to zero in block D10. Otherwise the mud pulse quality value is stored in block D11 (e.g. to return the mud pulse quality value to a user).

In block D12 the summary of the analysis is added to a historical record of recent past mud pulse summaries. In block D13 the historical record of recent past mud pulse summaries is cleaned (e.g. remove summaries that are older than a threshold amount (e.g. more than 10 cycles old)).

Block D14 determines a prototypical shape for mud pulses. The shape of the mud pulse may be found by comparing the found mud pulse shapes in the historical record of recent past mud pulse summaries and finding which shape repeats the most. Each time a mud pulse correlates well with another mud pulse (from the historical record of recent past mud pulse summaries) the mud pulse qualities of the two correlating pulses may be increased (e.g. by summing their quality values).

The shape of the mud pulse in the historical record of recent past mud pulse summaries that has the highest quality may be selected as the prototypical mud pulse shape. If two or more different mud pulses have the same summed quality, then an average of the two or more mud pulses may, for example, be selected as the prototypical mud pulse shape.

In some cases, a single mud pulse transmitted from a downhole location may be reflected by structures in the wellbore and/or drill rig such that the single mud pulse is received as a sequence of two or more pulses in the output signal from a transducer 14. For example, a transducer 14 may detect the transmitted pulse directly and may subsequently receive one or more echoes of the transmitted pulse. The time separation between detecting the original pulse and detecting an echo may be different for different transducers 14. In some cases the prototypical mud pulse shape may comprise a sequence of received pulses that collectively correspond to a mud pulse transmitted from a downhole location (e.g. a pulse and an echo of the pulse).

Mud pulses may, for example, be compared in the historical record of recent past mud pulse summaries by checking both whether the pulse taken together with another pulse that could be an echo matches a recent past mud pulse summary and whether the pulse taken on its own matches a recent past mud pulse summary. If there are more pulses with echo than without echo in the historical record of recent past mud pulse summaries then a summary for the pulse may specify a shape made of an average pulse with echo. If there are more pulses without echo than with echo in the historical record of recent past mud pulse summaries then a summary for the pulse may specify a shape that is an average pulse without echo.

In block D15 the mud pulse quality value is added to a list of recent mud pulse quality entries. The list or recent mud pulse quality entries may be cleaned (e.g. to remove values that are older than a threshold amount (e.g. more than 10 cycles old)).

In block D16 a new mud pulse quality is determined from the list of recent mud pulse quality entries. For example, the new mud pulse quality may be determined by averaging the values in the list of recent mud pulse quality entries.

In block D17 determined values and/or characteristics are returned to a user. For example, mud pulse shape and mud pulse quality may be returned to a user.

In cases where the MP telemetry data includes error checking and correction bits decoder 34 may check the decoded data for errors and, if necessary apply error correction bits to correct the data, if possible.

Each decoder 34 of a particular decoding chain 30 may perform the same or a different decoding technique than other decoders 34 within a decoding chain set 24.

In some embodiments decoders 34 learn characteristic features of the MP telemetry data. For example, decoders 34 may learn characteristics of a header (e.g. pulse shape, pulse amplitude, pulse sequence, etc.). In some embodiments decoders 34 dynamically learn characteristic features of detected MP telemetry signals as the MP telemetry data and conditions in the wellbore change.

In MP telemetry data, information is often encoded in the relative timing of pressure pulses. A decoder 34 may associate pulses with different times in various ways. For example, a decoder may assign times to detected mud pulses in the output signal from a transducer 14 by detecting edges of the pulses and/or determining a center of mass for each of the pulses based on the profile of amplitude over time for the pulse.

In MP telemetry data, information may be encoded in the relative amplitudes of pressure pulses. A decoder 34 may associate pulses with different amplitudes in various ways. For example, the decoder 34 may identify a peak amplitude within a pulse or may determine an average amplitude or may integrate amplitude over all or a portion of the pulse.

Each decoder 34 may monitor a corresponding conditioned output signal for the presence of a pattern of pulses that corresponds to a header. The decoder 34 may, for example, calculate a correlation between header template sequence and a most recently acquired section of the filtered output signal. If the correlation exceeds a header correlation threshold then the decoder may consider that a header for a frame of MP telemetry data has been detected. If the correlation is lower than the header correlation threshold then the decoder 34 may wait until a header is detected at a later time. If the header correlation threshold is set too high then decoder 34 may miss identifying headers that are present in the conditioned output signal. If the header correlation threshold is set too low then the decoder 34 may mistakenly identify noise as corresponding to a header.

In some embodiments decoder 34 comprises frame logic. The frame logic may adaptively set the header correlation threshold. In some embodiments the frame logic comprises an A1 model. If the header correlation threshold is set too high and no headers are captured within a set amount of time during which headers are expected the frame logic may automatically reduce the header correlation threshold. If the header correlation threshold is too low and decoder 34 mistakenly identifies as headers portions of the conditioned output signal that do not contain a header (this condition may be determined by finding that too many headers have been captured) the frame logic may increase the header correlation threshold.

After a pump on event the frame logic may be configured to look for a header and if no header is found within an expected amount of time, the frame logic may reduce the header correlation threshold. The frame logic may use recently captured header correlation values (e.g. from the header correlation history) together with the reduced header correlation threshold in an attempt to re-capture a missed header.

Additionally, or alternatively, the frame logic may manage frame types. In a MP telemetry frame. For example, a frame may include a frame ID after a header. The frame ID may identify what type of frame the frame is. If decoder 34 mistakenly decodes the frame ID or fails to decode the frame ID, decoder 34 may abandon and discard the frame or may decode incorrect data. Advantageously, the frame logic may assist decoder 34 with making correct decoding decisions and may create background frames (e.g. frames which may replace a frame currently being decoded) with different frame types to assist decoder 34.

In some embodiments decoder 34 determines a value representing the confidence of a decoded frame ID (e.g. a probability that the decoded frame ID is correct). The confidence of the decoded frame ID may be determined at least partially based on an expected frame ID. For example, decoding system 20 may expect a certain type of frame following specific drilling events (e.g. pump ON, pump OFF, etc.). In some cases a certain type of frame immediately follows another type of frame.

In some embodiments once a frame has been decoded, decoder 34 uses the decoded frame to establish an expected timing for receiving a subsequent frame. The expected timing may include approximately when the next frame is expected to arrive, the timing sequence of pulses within a frame, etc. In some embodiments the determination of the expected timing at least partially considers a measure of quality of the decoded data (e.g. based on confidence values).

Additionally, or alternatively, based on the decoded frame decoder 34 may predict what the next frame is likely to be.

Such prediction alone or in combination with one or more of a measure of quality of the decoded data (e.g. based on confidence values), expected frame timing, etc. may be used by decoder 34 to determine whether a currently decoded frame is actually a frame or not. In some embodiments decoder 34 may force decoding of a certain type of frame.

In some embodiments if a header is not found within the expected time for receiving a frame, decoder 34 (or decoding chain 30) reduces a header correlation threshold (e.g. a threshold for classifying pulses as a header) to try to capture a header of the next frame (i.e. reduce threshold to classify data as a header in order to try to capture the header of the next frame).

In some embodiments if a header is not found within the expected time for receiving the next frame, decoder 34 (or decoding chain 30) may reduce a header correlation threshold to try to capture the missed frame. As described elsewhere herein, the frame logic may use recently captured header correlation values (e.g. from the header correlation history) together with the reduced header correlation threshold in an attempt to re-capture a missed header.

In some embodiments if a decoder 34 decodes two headers during a period within which only one header should be present then the frame logic of decoder 34 may process the conditioned output signal based on the header with a higher header correlation (i.e. a measure of how likely the header corresponds to an actual header) and discard the other header.

Additionally, or alternatively, the frame logic may generate and/or force headers for certain frames. For example, if decoding system 20 expects a header but cannot find it in the conditioned output signal, the frame logic may insert a header and attempt to decode the data using the inserted header as a start of a frame. The inserted frame may be based on a timing of a previously decoded header. In some embodiments the frame logic generates and/or forces a header only if a header could not be found even when the header correlation threshold is lowered.

In some embodiments decoders 34 may maintain a model of the drilling operation and use the model to predict values for certain drilling parameters (e.g. continuous azimuth and/or continuous inclination). Decoders 34 may compare newly decoded values for these parameters against recent values derived from the model. In some embodiments if the newly decoded values do not sufficiently correspond to the recent values in the model (e.g. within 10%, 5%, 1%, etc.) then the new decoded values may automatically be identified as unreliable.

In some embodiments decoder 34 is configured to adaptively detect headers. In particular decoder 34 may learn specific characteristics of headers of the MP telemetry data frames being transmitted. Distortions caused by propagation of MP telemetry signals to a transducer 14 can cause the same header to appear significantly different in the data output by the transducer 14 depending on conditions in the wellbore. The learned headers or learned characteristics may be used to improve decoding accuracy.

In some cases decoder 34 may begin by detecting a number of header candidates, assuming that each of the header candidates is followed by encoded data and attempting to decode the assumed encoded data.

Header candidates for which data was successfully decoded from following portions of the conditioned output signal are identified as verified headers. Signals corresponding to the verified headers may be stored and used as templates to detect subsequent headers. In some embodiments the signals corresponding to the verified headers are averaged together to yield a normalized header template for correlation purposes.

Newly detected headers corresponding to frames which were successfully decoded may be averaged with the normalized header template to further improve the normalized header template. The normalized header template may be used as a reference basis to detect headers of newly transmitted frames.

In some example cases a decoder 34 (or mud pulse analyzer within a decoder 34) may learn to identify the pulses which make up MP telemetry data as follows:

1. Process a chunk of the conditioned output data to identify characteristics of any pulses represented in the data chunk. In some cases a chunk of the conditioned output data is processed and all pulses are extracted from it. The extracted pulses may be stored (e.g. in memory).
2. Sort the identified pulses of the data chunk into a selected number of categories. For example, higher amplitude pulses may be sorted with other higher amplitude pulses, small amplitude pulses may be sorted with other small amplitude pulses, medium amplitude pulses with other medium amplitude pulses, etc. The number of sorting categories or "bins" may be chosen arbitrary (e.g. some implementations may use only two bins for sorting pulses—smaller than a threshold and larger than a threshold). In other implementations more bins (e.g. 4 or 5 or 6 different bins may be used).
3. Compare the number of pulses sorted into each category to the number of pulses expected for each category. The pulses from the category that best matches the expected number may be selected for further processing. If no category fits well (too few pulses) then the process may be terminated. In some embodiments a bin must have a total amount of pulses that is more than an expected amount of pulses to be selected for further processing. In some embodiments the bins are assessed from the bins with the largest amplitude pulses to the bins with the smallest amplitude pulses.
4. If the number of pulses for the selected category exceeds the expected number of pulses then check to see if any two of the pulses in the selected category are separated by a time difference that is shorter than a threshold time. If so, concatenate the two pulses together and treat the concatenated pulses as a single pulse. In some embodiments the widths of both pulses to be concatenated with one another must be smaller than a threshold width in order for the pulses to remain a candidate for concatenation with one another. Any of the conditions for concatenation described above may be assessed in any order. In some embodiments such pulse concatenation is performed outside of the example process described in this section (e.g. may be performed as part of another decoding process, etc.).
5. Review the number of pulses after step 4. If the number of pulses is within an acceptable threshold (based on the number of expected pulses from the selected group of pulses) determine an average pulse shape for the pulses in the selected group. Additionally, or alternatively, based on the number of pulses a quality of the mud pulses may be determined.
6. The average pulse shape may then be stored (e.g. in a data store) as a recently recorded mud pulse shape. All recently recorded mud pulse shapes may be compared. If some pulses are very different from the other pulses they may be ignored. The remaining pulses (those that appear to fit with each other and are similar to each other) may be grouped and their average may be calculated and returned to decoder 34 as a reference mud pulse shape.

7. The reference mud pulse shape may be used as a reference to detect/receive pulses in MP telemetry data. For example, the reference mud pulse shape may be used to detect pulses corresponding to data messages of MP telemetry data frames.

The above steps may be performed together with or as a part of example method 34A described elsewhere herein and illustrated in FIG. 3D or may be completely separate from example method 34A.

Initially, decoder 34 may mistakenly identify a header in a part of the conditioned output signal that does not include a header. However as decoder 34 decodes more data and accumulates a history of mud pulse shapes the chances of decoder 34 mistakenly identifying a header may decrease.

Decoder 34 may, for example, initially set a header template to a default header template (e.g. defining a default pulse width, timing, sequence, etc.). In some cases the default header template is based on the particular transducer by which the data is being received. As frame headers are detected they may be stored (e.g. in a data store). Some or all of the stored frame headers may be combined (e.g. averaged) to create a new header template. The new header template may be used for finding/detecting newly transmitted MP telemetry data frames. Additionally, or alternatively, the most recently found and verified header may be stored and used as a template for future header correlation. These methods allow the header template as well as templates that may be used to recognize individual pulses to evolve as conditions change.

FIGS. 6-10 are flow charts showing example processes that may be performed by a decoder 34 and/or decoding system 20. FIGS. 6-10 illustrate example processes. In some cases each MP telemetry frame comprises a header, a frame ID (e.g. two symbols) and a data payload. In some embodiments a MP telemetry frame additionally comprises error correction bits (e.g. CRC/parity bits) at the end of the frame. A length of the frame (e.g. the number of symbols in the frame) may vary based on the amount of information to be transmitted in the frame, accuracy (e.g. quantization of data into bits) of the information to be transmitted, amount of CRC/parity bits, etc.

For the purposes herein "header correlation" means a value that represents the likelihood that a section of the conditioned output signal represents the header of a MP telemetry data frame.

Figure 6:
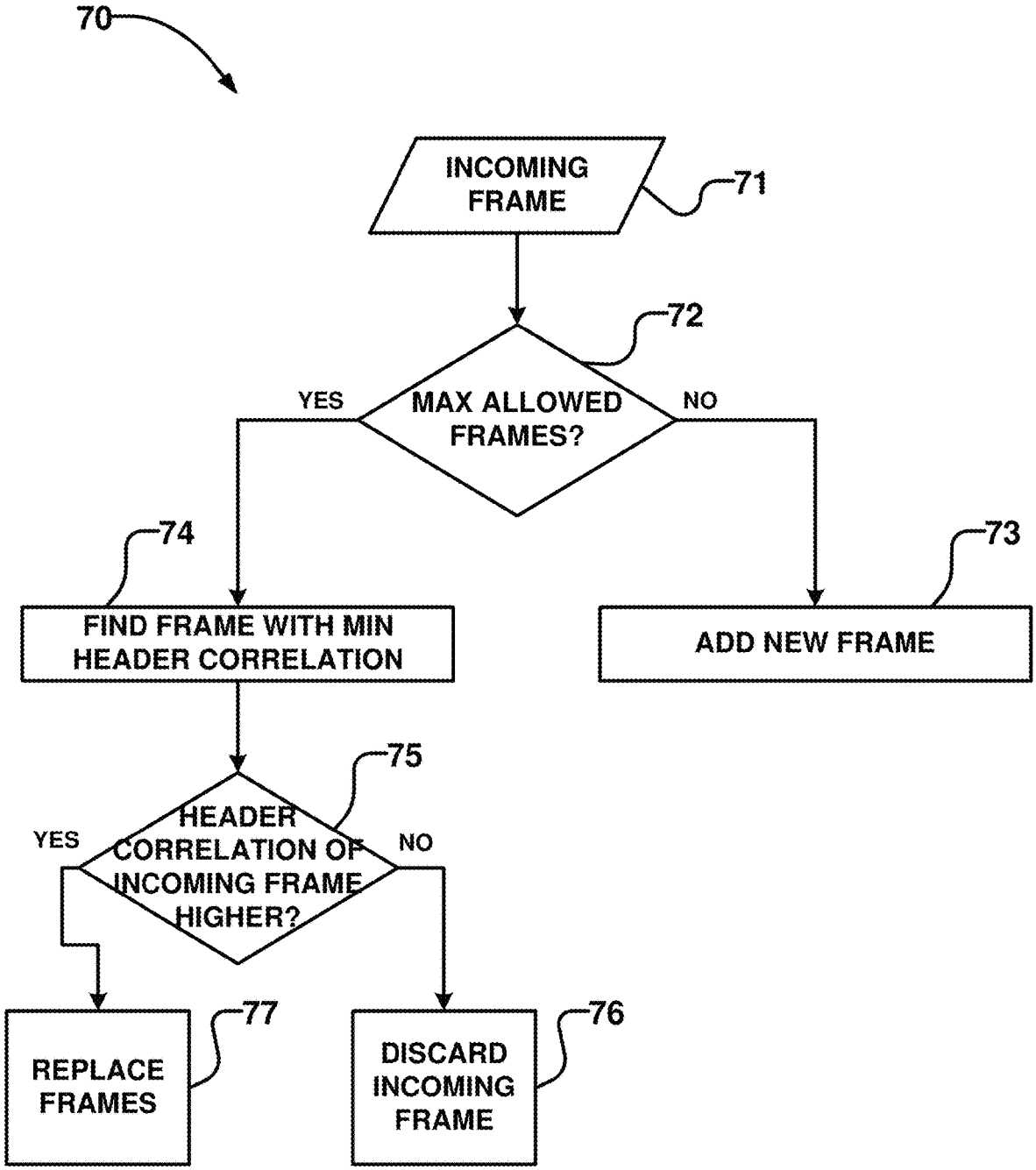
FIGS. 6-10 are flow charts showing decoding methods according to example embodiments of the invention.

FIG. 6 is a flow chart showing an example method 70 for receiving an incoming frame 71 of data. Each incoming frame 71 may be processed by a decoding chain 30 as described elsewhere herein.

Block 72 determines whether the system is at a maximum number of allowed frames. A maximum number of allowed frames may correspond to an amount of memory available to store the incoming frames. In some embodiments the maximum number of allowed frames is 10 or less. In some embodiments the maximum number of allowed frames is 5 or less. If the system is not at a maximum number of allowed frames then a new frame may be added in block 73. If the system is at a maximum number of allowed frames then block 74 finds a frame from the existing frames which has the smallest header correlation (e.g. the frame which has the smallest likelihood of having a proper header).

Block 75 determines whether the header correlation of incoming frame 71 is greater than the header correlation of the existing frame which has the smallest header correlation of the existing frames. In some embodiments block 75 compares the header correlation of incoming frame 71 to the smallest header correlation (of an of the existing frames) plus an additional threshold padding (e.g. 1%, 5%, 10%, etc.). If the comparison results in the header correlation of incoming frame 71 being less than or equal to the compared to correlation value, incoming frame 71 is discarded in block 76. Otherwise, the incoming frame 71 replaces the existing frame with the smallest header correlation in block 77.

Figure 7:
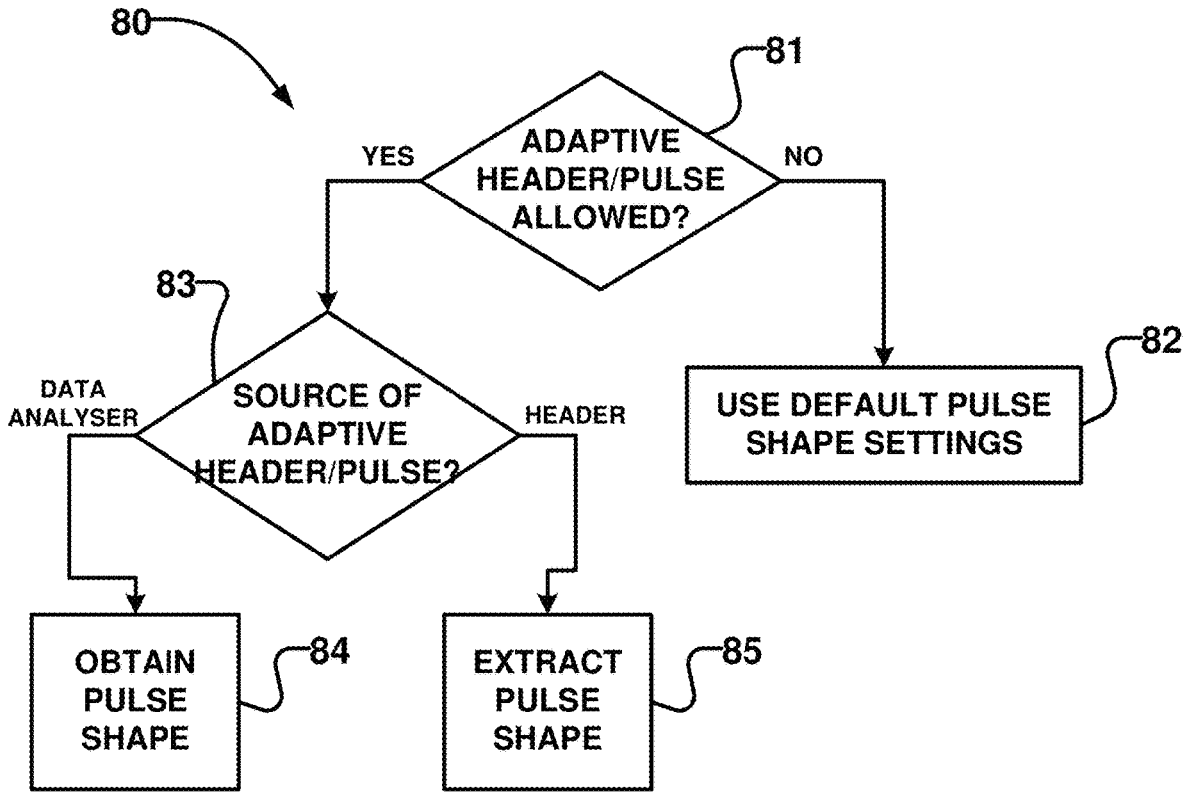

FIG. 7 is a block diagram showing an example method 80 for adding a new incoming frame 71.

Block 81 determines whether adaptive header and/or pulses are supported by decoding system 20 (e.g. whether decoding system 20 supports learning of specific characteristics of headers and/or pulses from the MP telemetry data). If adaptive headers are not supported, decoder 34 is set to use default pulse shape settings in block 82 (e.g. the pulse shape expected to be received based on an ideal mud pulse waveform without any distortion, perturbations and/or the like). Otherwise block 83 determines what the source of the adaptive header and/or pulses will be.

If the source of the adaptive header and/or pulses will be the data analyzer of decoder 34, then the pulse shape is obtained from the data analyzer and a shape of the header is captured in block 84. If the source of the adaptive header and/or pulses will be the header itself, then an expected pulse shape is extracted from the header itself in block 85.

In some embodiments, frames to be decoded are each one of two types: (i) main frames (e.g. frames being actively decoded and/or processed); and (ii) background frames (e.g. frames being decoded and/or processed in the background while another frame is still being actively decoded and/or processed by a decoder 34).

Figure 8:
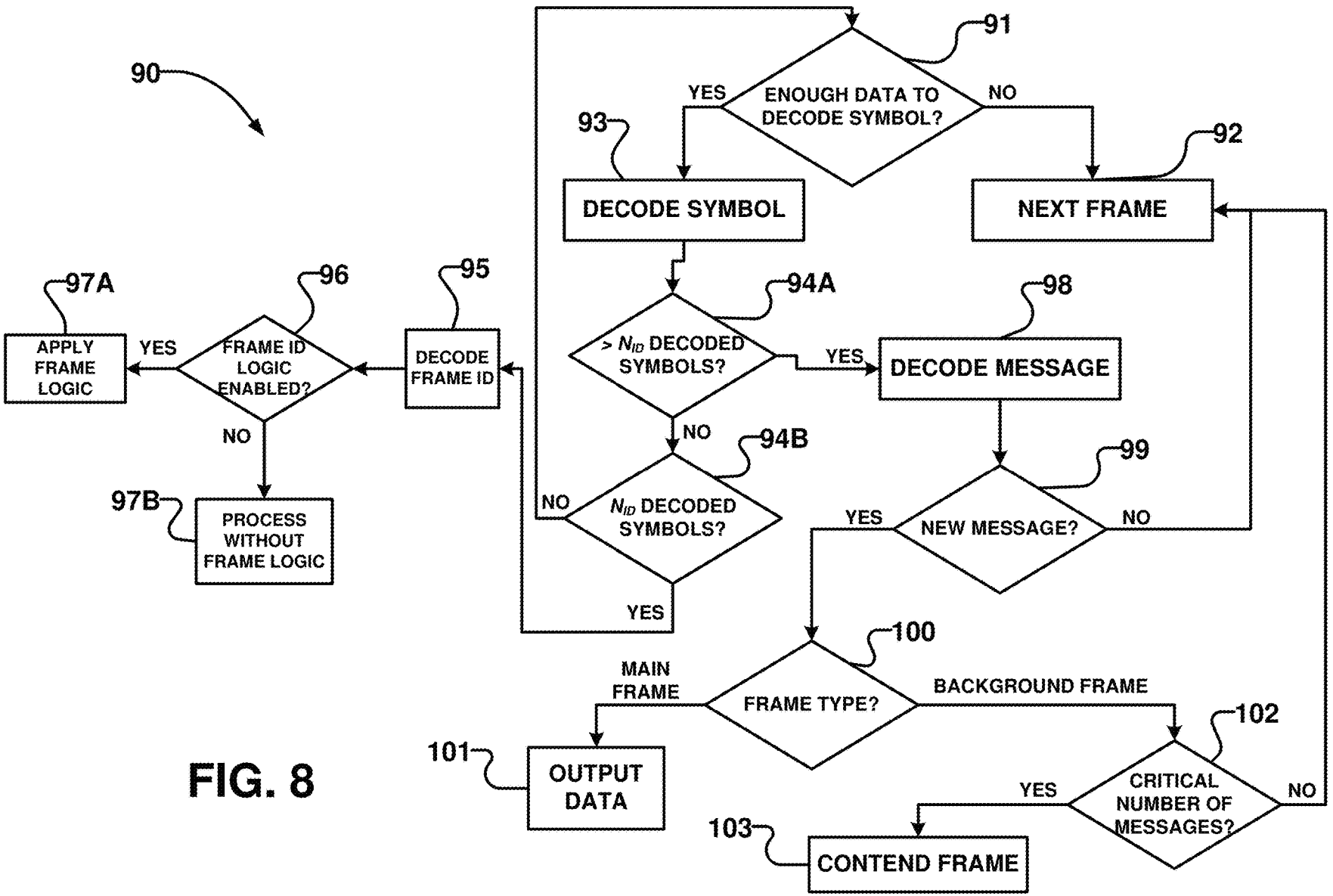

FIG. 8 is a block diagram showing an example method 90 for adding data to a frame. Method 90 may, for example, be performed by a decoding chain 30 (or decoder 34) to process a plurality of data frames.

Block 91 determines whether there is enough data to decode a symbol. If there is not enough data, method 90 may move onto the next frame or end (if there are no additional frames) in block 92. Otherwise method 90 decodes the symbol in block 93.

Block 94A determines if there are more than the correct number of decoded symbols corresponding to a frame ID (i.e. the required number N/D of symbols corresponding to the frame ID and required to decode the frame ID). In some embodiments a frame ID comprises exactly two decoded symbols (e.g. first two pulses which provide information about what kind of information will be encoded in the rest of the pulses). If so, block 98 may commence decoding a message. Otherwise block 94B determines whether there is the correct number of decoded symbols corresponding to a frame ID. If not, method 90 returns to block 91.

If there is the correct number of decoded symbols corresponding to the frame ID block 95 decodes the frame ID. Block 96 determines whether frame ID logic is enabled. If frame ID logic is enabled, method 90 may proceed to block 97A. If frame ID was not decoded properly, frames may be added based on a probability of what the frame ID should have been in block 97A. Additionally, or alternatively, if the decoded frame ID does not match an expected timing, then block 97A may override the decoded frame ID (e.g. as described elsewhere herein).

If frame ID logic is not enabled, method 90 may proceed to block 97B. If the frame ID was decoded block 97B may add a frame with the corresponding ID. If the frame ID failed to decode then block 97B may discard the frame.

Additionally, or alternatively, if there are more than the required number $N_{ID}$ of decoded symbols block 98 may check whether there is enough data to decode a message (e.g. there is the expected number of information symbols, CRC/parity bits, etc.). If there is enough data to decode a message, block 98 will decode the message.

In some embodiments a decoder 34 decodes multiple data frames simultaneously (e.g. if a decoder 34 is decoding one frame and another header is detected (e.g. having a header correlation over a threshold amount), the frame corresponding to the other header may be decoded in the background.

In some embodiments decoders 34 may shift timing of decoded symbols of the data for error correction (e.g. CRC/parity correction).

Block 99 determines whether a new message was decoded. If a new message was not decoded, method 90 returns to block 92. If a new message was decoded then block 100 determines what type of frame the incoming frame is. If the frame is a main frame the decoded data may be output to a user in block 101. If the frame is a background frame then block 102 determines if a critical amount of messages has been reached. A typical frame may, for example, comprise about 30 messages. In some embodiments a critical amount of messages is less than about 15 messages. In some embodiments a critical amount of messages is about 10 messages. If a confidence (as described elsewhere herein) of a background frame is better than a threshold confidence and the quality of the main frame, then it is likely the case that the background frame is a true frame while the main frame is a false positive (i.e. the header of the main frame was not actually a header). In such cases the main frame may be discarded and the background frame may be set as the main frame.

If a critical amount of messages has not been reached method 90 returns to block 92 and proceeds to move onto a next frame. If a critical amount of messages has been reached method 90 may proceed to determine whether the background frame should replace the main frame in block 103.

Figure 9:
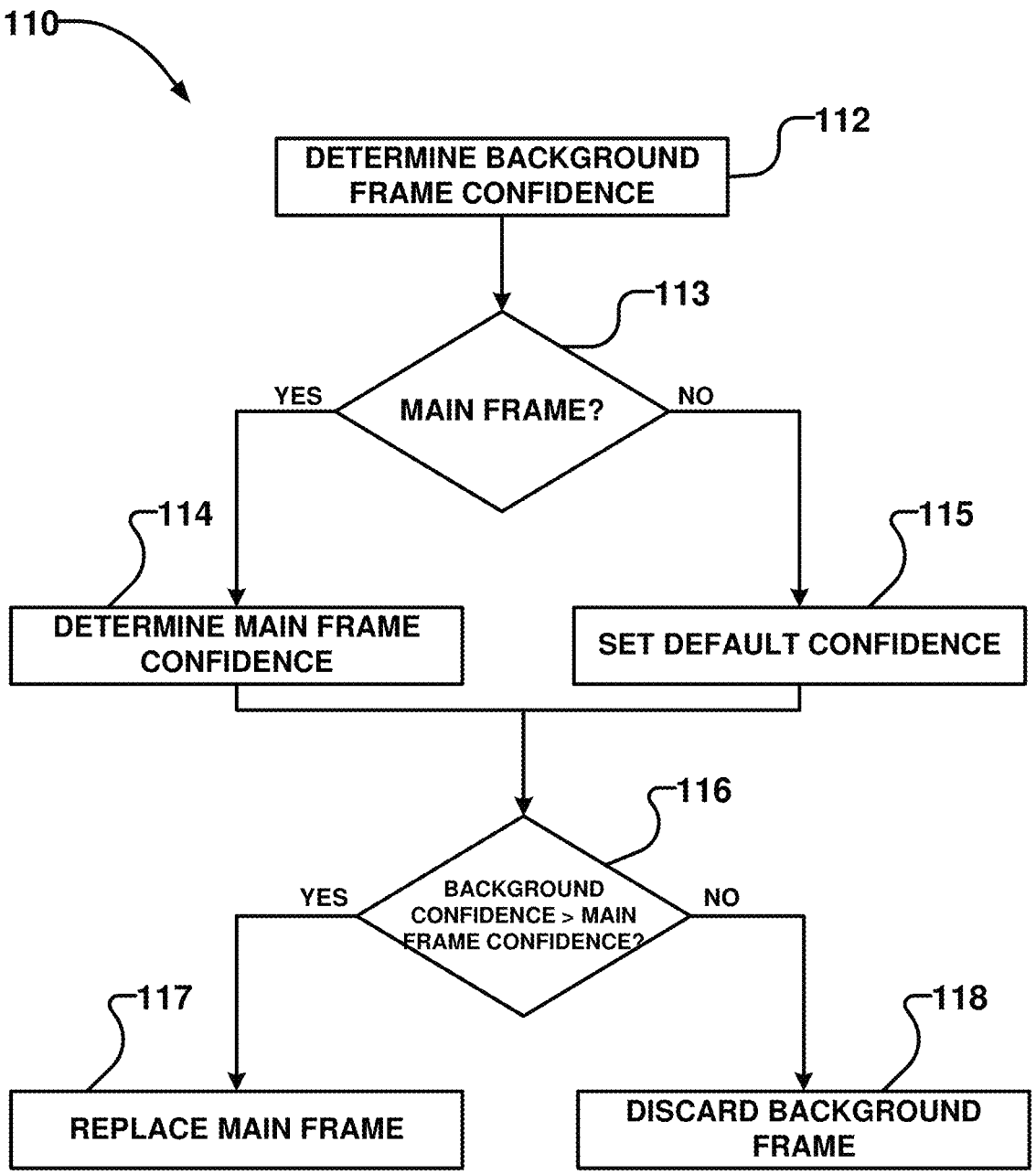

FIG. 9 is a block diagram showing an example method 110 for determining whether a background frame should replace a current main frame as the main frame.

In block 112 an average message confidence of the background frame may be determined (the "Contender Confidence"). Message confidence may at least partially be determined based on CRC or other parity check bits which are transmitted with a particular message. Additionally, or alternatively, each decoded symbol (e.g. N bits per symbol has a corresponding associated confidence of the decoding. In some cases each decoded symbol is 3 bits. The confidence of the symbol decoding may be based on how much the timing of the decoded symbol differs from an ideal timing. Message confidence may be determined by taking an average of the confidences of each of the symbols in the message. If a decoded message does not pass an error check (e.g. CRC or other parity check) then the confidence of that message may be set to zero.

An overall confidence of a frame may be determined by taking an average of the confidences of all messages currently decoded in the frame.

Block 113 determines whether a main frame currently exists. If a main frame does exist, block 114 determines a confidence of the main frame (i.e. a confidence of the messages in the main frame). If a main frame does not exist, block 115 sets a confidence of the "main frame" to a default value. The default value may be user defined. In some embodiments the default values is about 40%-60%. In some embodiments the default value is about 50%.

Block 116 determines whether the confidence of the background frame is greater than the confidence of the main frame (or the default value if no main frame exists). If so, the background frame is set as the main frame in block 117. All previously decoded messages in the background frame may be output (e.g. to a user). The previous main frame is discarded.

Conversely, if the confidence of the background frame is not greater than the confidence of the main frame (or the default value if no main frame exists) the background frame is discarded in block 118.

Figure 10:
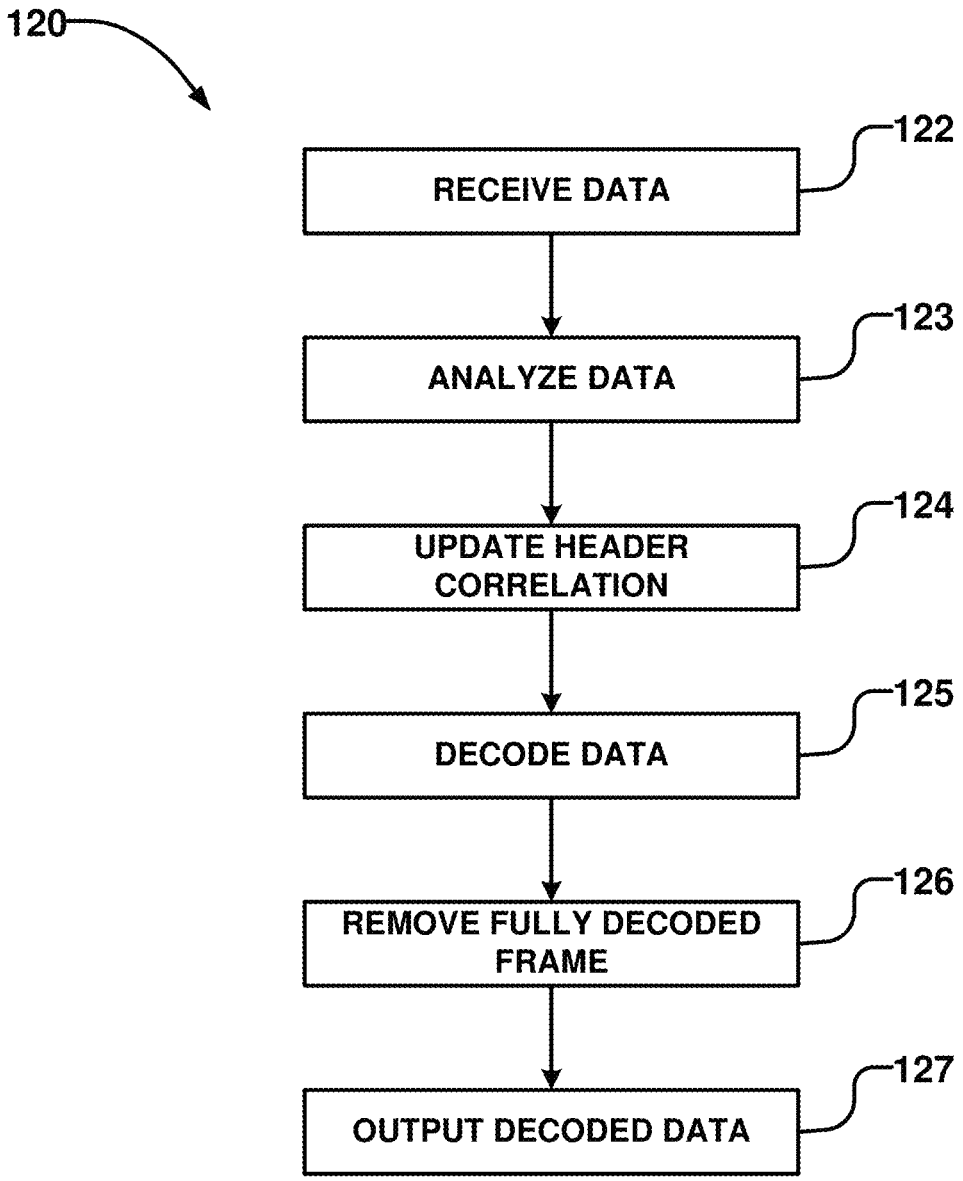

FIG. 10 is a block diagram showing an example general overview method 120 for decoding data received by decoder 34. Method 120 may be performed by decoder 34.

Block 122 receives transducer output signal data. The data may be analyzed in block 123 (e.g. by a data analyzer as described elsewhere herein). Analyzing the data may, for example, comprise identifying pulses in the transducer output signal which may encode MP telemetry data, measuring timing between adjacent pulses, measuring amplitudes of the pulses, etc.

In block 124 header correlation of the data is updated. Typically the higher amplitude the header peak is within the header correlation signal the higher the confidence of identifying the header peak is. As described above, multiple chains 30 may decode a data signal in parallel. If a new header is identified by one of chains 30 then a new frame may be added corresponding to the new header. However, if decoders 34 are at capacity (i.e. no more frames can be decoded by decoders 34) then:

(i) correlations of previously captured headers are compared;

(ii) the header with the lowest correlation is found;

(iii) a correlation of the newly found header is compared against the lowest correlation.

As described elsewhere herein if the comparison results in the header correlation of the newly found header being less than or equal to the compared to value, the newly discovered header may be discarded. Otherwise, the newly discovered header may replace the existing frame corresponding to the existing header with the smallest header correlation.

In some embodiments blocks 123 and 124 occur concurrently despite being illustrated as occurring sequentially in FIG. 10.

In block 125 the data is decoded. Once a frame is fully decoded the fully decoded frame is removed in block 126. In block 127 the determined header correlation and decoded data are output (e.g. to a user).

Various elements have been described herein as comprising a trained artificial intelligence system. The trained artificial intelligence system may be trained by supervised or unsupervised learning methods. The trained artificial intelligence system may comprise a machine learning model such as a neural network model, linear regression model, logistic regression model, decision tree model, a support vector machine (SVM) model, a naive bayes model, a kNN model, a K-Means model, a random forest model and/or the like.

Various processes have been described herein. Some processes have been described as being performed by specific functional units (e.g. decoder 34, auditor 26, conductor 28, etc.). Nevertheless the processes described herein need not be performed by specific functional units in all cases. For example, in some embodiments conductor 28 may perform the processes of both conductor 28 and auditor 26. Any process described herein may be performed by any functional unit and/or any number of functional units.

Enumerated Example Embodiments

The following are non-limiting example embodiments of the technology described herein. It is emphasized that any of the example embodiments below may be a stand-alone embodiment or may be combined with any other embodiment, feature or combination of features described herein.

L1. A method for receiving downhole telemetry data from a drilling operation, the method comprising:
- transmitting data from a downhole location by mud pulse telemetry;
- receiving the transmitted mud pulse telemetry data at a plurality of transducers, each of the transducers positioned at a different location of the drilling operation;
- processing the received data from the plurality of transducers to decode the transmitted data; and
- selecting which one of the decoded data items most likely corresponds to the transmitted mud pulse telemetry data.

L2. The method according to embodiment L1 wherein processing the received data from the plurality of transducers comprises decoding the received data with a plurality of decoding chains.

L3. The method according to embodiment L2 wherein the plurality of decoding chains comprises at least one decoding chain for a corresponding one of each of the plurality of transducers.

L4. The method according to embodiment L3 wherein the plurality of decoding chains comprises at least one set of plural decoding chains corresponding to at least one of the plurality of transducers.

L5. The method according to any one of embodiments L2 to L4 wherein the decoding chains each comprise at least one filter.

L6. The method according to embodiment L5 wherein the at least one filter comprises a low pass filter.

L7. The method according to embodiment L5 or L6 wherein the at least one filter comprises a high pass filter.

L8. The method according to any one of embodiments L2 to L7 wherein the received data is filtered by a pump noise filter prior to being processed by the plurality of decoding chains, the pump noise filter configured to supress pump noise from the received data.

L9. The method according to embodiment L8 wherein the received data from each of the plurality of transducers is filtered by a different pump noise filter.

L10. The method according to embodiment L9 wherein the received data from each of the plurality of transducers is autonomously filtered by a different pump noise filter.

L11. The method according to any one of embodiments L8 to L10 wherein settings of the pump noise filter are varied as pump noise varies.

L12. The method according to embodiment L11 wherein settings of the pump noise filter are autonomously varied as pump noise varies.

L13. The method according to any one of embodiments L2 to L12 wherein the decoding chains each further comprise a clipper configured to clip data relative to a threshold value.

L14. The method according to embodiment L13 wherein the clippers are configured to clip data which falls below the threshold value.

L15. The method according to any one of embodiments L2 to L14 wherein selecting which one of the decoded data items most likely corresponds to the transmitted mud pulse telemetry data comprises selecting an output of one of the decoding chains which is the most likely to be correct.

L16. The method according to embodiment L15 wherein the output which is the most likely to be correct is determined by comparing confidence of a plurality of decoded data items.

L17. The method according to embodiment L16 wherein confidence of a decoded data item is based at least partially on a confidence value that a header corresponding to the decoded data item is correctly identified as a header.

L18. The method according to embodiment L17 wherein detection of the header is based at least partially on a comparison of a suspected header to a header model.

L19. The method according to embodiment L18 wherein the header model is varied as header values are correctly decoded.

L20. The method according to embodiment L19 wherein varying the header model comprises averaging a plurality of correct header values together.

L21. The method according to any one of embodiments L2 to L20 further comprising varying at least one performance parameter of the plurality of decoding chains to improve the likelihood that at least one decoding chain will correctly decode the received data.

L22. The method according to embodiment L21 wherein varying at least one performance parameter of the plurality of decoding chains comprises varying filter settings of at least one of the plurality of decoding chains.

L23. The method according to embodiment L22 wherein filter settings of the at least one of the plurality of decoding chains are varied autonomously.

L24. The method according to embodiment L21 or L23 comprising adding or removing decoding chains from the plurality of decoding chains.

L25. The method according to embodiment L24 wherein the decoding chains are added or removed from the plurality of decoding chains autonomously.

L26. A system for receiving downhole telemetry data from a drilling operation, the system comprising:
- a downhole mud pulse (MP) telemetry transmitter configured to transmit data uphole;
- a plurality of transducers configured to sense drilling fluid pressure changes corresponding to transmitted MP telemetry data; and
- at least one controller configured to perform the method of any one of embodiments L1 to L21 to decode received MP telemetry data.

M1. A method for identifying a sequence of pulses representing a header of a mud pulse (MP) telemetry data message, the method comprising:
- measuring with a transducer changes in pressure of a drilling fluid, at least some of the measured changes in pressure corresponding to encoded MP telemetry data;

comparing a window of measurements from the transducer against a template representing the header to determine a correlation value representing how similar the window of measurements is to the template;

identifying the window of measurements as comprising the header by comparing the correlation value against a threshold value; and dynamically varying the template as windows of measurements comprising the header are identified.

M2. The method according to embodiment M1 wherein the window of measurements is identified as comprising the header if the correlation value is greater than or equal to the threshold value.

M3. The method according to embodiment M1 or M2 wherein dynamically varying the template comprises averaging the template values with measurement values of the measurement windows identified as comprising the header.

M4. The method according to embodiment M3 wherein the averaging comprises a weighted average.

M5. The method according to any one of embodiments M1 to M4 wherein the template initially comprises a sequence of expected pressure pulses.

N1. A method for detecting mud pulse (MP) telemetry data, the method comprising:

measuring with a transducer changes in pressure of a drilling fluid, at least some of the measured changes in pressure corresponding to encoded MP telemetry data;

determining a prototypical shape for the measured changes in pressure corresponding to encoded MP telemetry data; and comparing the measured changes in pressure against the prototypical shape to detect encoded MP telemetry data.

N2. The method according to embodiment N1 wherein determining the prototypical shape comprises:

comparing previously measured changes in pressure that corresponded to encoded MP telemetry data; and determining a shape of the previously measured changes in pressure that has the highest rate of occurrence.

N3. The method according to embodiment N2 comprising selecting the shape of the previously measured changes in pressure that has the highest rate of occurrence as the prototypical shape for the measured changes in pressure corresponding to encoded MP telemetry data.

N4. The method according to any one of embodiments N1 to N3 comprising comparing a measured change in pressure against the prototypical shape to determine a likelihood of the measured change in pressure corresponding to encoded MP telemetry data.

N5. The method according to any one of embodiments N1 to N4 comprising sorting measured changes in pressure.

N6. The method according to embodiment N5 wherein the measured changes in pressure are sorted based on energy levels or amplitudes of the measured changes in pressure.

N7. The method according to embodiment N5 or N6 comprising selecting ones of the sorted measured changes in pressure which have the highest likelihood of corresponding to encoded MP telemetry data for comparison against the prototypical shape.

N8. The method according to embodiment N7 wherein the measured changes in pressure having the highest energy levels or amplitudes are selected as having the highest likelihood of corresponding to encoded MP telemetry data.

N9. The method according to any one of embodiments N1 to N8 comprising concatenating at least two measured changes in pressure together.

N10. The method according to any one of embodiments N1 to N9 comprising determining a quality of the measured changes in pressure.

N11. The method according to embodiment N10 wherein the quality of the measured changes in pressure is at least partially determined based on the comparison of the measured changes in pressure against the prototypical shape.

N12. The method according to any one of embodiments N1 to N11 comprising updating the prototypical shape based on currently detected MP telemetry data.

N13. The method according to any one of embodiments N1 to N12 wherein the measured changes are filtered by a pump noise filter, the pump noise filter configured to supress pump noise.

N14. The method according to embodiment N13 comprising varying settings of the pump noise filter as pump noise varies.

N15. The method according to embodiment N14 wherein settings of the pump noise filter are autonomously varied as pump noise varies.

N16. The method according to any one of embodiments N1 to N12 comprising filtering the measured changes with a plurality of pump noise filters, each of the pump noise filters configured to supress pump noise.

N17. The method according to embodiment N16 comprising determining a prototypical shape for the measured changes in pressure corresponding to encoded MP telemetry data for each pump noise filter of the plurality of pump noise filters.

Interpretation of Terms

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to";

"connected", "coupled", or any variant thereof, means any connection or coupling, either direct or indirect, between two or more elements; the coupling or connection between the elements can be physical, logical, or a combination thereof;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Embodiments of the invention may be implemented using specifically designed hardware, configurable hardware, programmable data processors configured by the provision of software (which may optionally comprise "firmware") capable of executing on the data processors, special purpose computers or data processors that are specifically programmed, configured, or constructed to perform one or more steps in a method as explained in detail herein and/or combinations of two or more of these. Examples of specifically designed hardware are: logic circuits, application-specific integrated circuits ("ASICs"), large scale integrated circuits ("LSIs"), very large scale integrated circuits ("VLSIs"), and the like. Examples of configurable hardware are: one or more programmable logic devices such as programmable array logic ("PALs"), programmable logic arrays ("PLAs"), and field programmable gate arrays ("FPGAs"). Examples of programmable data processors are: microprocessors, digital signal processors ("DSPs"), embedded processors, graphics processors, math co-processors, general purpose computers, server computers, cloud computers, mainframe computers, computer workstations, and the like. For example, one or more data processors in a control circuit for a device may implement methods as described herein by executing software instructions in a program memory accessible to the processors.

Processing may be centralized or distributed. Where processing is distributed, information including software and/or data may be kept centrally or distributed. Such information may be exchanged between different functional units by way of a communications network, such as a Local Area Network (LAN), Wide Area Network (WAN), or the Internet, wired or wireless data links, electromagnetic signals, or other data communication channel.

For example, while processes or blocks are presented in a given order, alternative examples may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed at different times.

In addition, while elements are at times shown as being performed sequentially, they may instead be performed simultaneously or in different sequences. It is therefore intended that the following claims are interpreted to include all such variations as are within their intended scope.

The invention may also be provided in the form of a program product. The program product may comprise any non-transitory medium which carries a set of computer-readable instructions which, when executed by a data processor, cause the data processor to execute a method of the invention. Program products according to the invention may be in any of a wide variety of forms. The program product may comprise, for example, non-transitory media such as magnetic data storage media including floppy diskettes, hard disk drives, optical data storage media including CD ROMs, DVDs, electronic data storage media including ROMs, flash RAM, EPROMs, hardwired or preprogrammed chips (e.g., EEPROM semiconductor chips), nanotechnology memory, or the like. The computer-readable signals on the program product may optionally be compressed or encrypted.

In some embodiments, the invention may be implemented in software. For greater clarity, "software" includes any instructions executed on a processor, and may include (but is not limited to) firmware, resident software, microcode, and the like. Both processing hardware and software may be centralized or distributed (or a combination thereof), in whole or in part, as known to those skilled in the art. For example, software and other modules may be accessible via local memory, via a network, via a browser or other application in a distributed computing context, or via other means suitable for the purposes described above.

Where a component (e.g. a software module, processor, assembly, device, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology, and/or omitting combining features, elements and/or acts from described embodiments.

Various features are described herein as being present in "some embodiments". Such features are not mandatory and may not be present in all embodiments. Embodiments of the invention may include zero, any one or any combination of two or more of such features. This is limited only to the extent that certain ones of such features are incompatible with other ones of such features in the sense that it would be impossible for a person of ordinary skill in the art to construct a practical embodiment that combines such incompatible features. Consequently, the description that "some embodiments" possess feature A and "some embodiments" possess feature B should be interpreted as an express indication that the inventors also contemplate embodiments which combine features A and B (unless the description states otherwise or features A and B are fundamentally incompatible).

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A method for receiving downhole telemetry data from a drilling operation, the method comprising:

transmitting data from a downhole location by mud pulse telemetry;

receiving the transmitted mud pulse telemetry data at one or more transducers, each of the one or more transducers positioned at a different location of the drilling operation;

processing the received data from the one or more transducers to decode the transmitted data into a plurality of candidate decoded data items, wherein processing the received data from the one or more transducers comprises decoding the received data with a plurality of decoding chains into the plurality of candidate decoding items; and selecting which one of the candidate decoded data items most likely corresponds to the transmitted mud pulse telemetry data, wherein selecting which one of the candidate decoded data items most likely corresponds to the transmitted mud pulse telemetry data comprises selecting an output of one of the decoding chains which is the most likely to be correct and wherein the output which is the most likely to be correct is determined by comparing confidence of the plurality of decoded data items.

2. The method according to claim 1 wherein each decoding chain comprises different decoding parameters to thereby decode the received data into a corresponding candidate decoded data item using a corresponding set of decoding parameters.

3. The method according to claim 1 wherein the plurality of decoding chains comprises at least one decoding chain for a corresponding one of each of the one or more transducers.

4. The method according to claim 3 wherein the plurality of decoding chains comprises at least one set of plural decoding chains corresponding to at least one of the one or more transducers.

5. The method according to claim 1 wherein the decoding chains each comprise at least one filter.

6. The method according to claim 5 wherein the at least one filter comprises a low pass filter.

7. The method according to claim 5 wherein the at least one filter comprises a high pass filter.

8. The method according to claim 1 wherein the received data is filtered by a pump noise filter prior to being processed by the plurality of decoding chains, the pump noise filter configured to suppress pump noise from the received data.

9. The method according to claim 8 wherein the received data from each of the one or more transducers is filtered by a different pump noise filter.

10. The method according to claim 9 wherein the received data from each of the one or more transducers is autonomously filtered by the different pump noise filter.

11. The method according to claim 8 wherein settings of the pump noise filter are varied as pump noise varies.

12. The method according to claim 11 wherein settings of the pump noise filter are autonomously varied as the pump noise varies.

13. The method according to claim 1 wherein the decoding chains each further comprise a clipper configured to clip data relative to a threshold value.

14. The method according to claim 13 wherein the clippers are configured to clip data which falls below the threshold value.

15. The method according to claim 1 wherein the confidence of a decoded data item is based at least partially on a confidence value that a header corresponding to the decoded data item is correctly identified as a header.

16. The method according to claim 15 wherein identification of the header is based at least partially on a comparison of a suspected header to a header model.

17. The method according to claim 16 wherein the header model is varied as header values are correctly decoded.

18. The method according to claim 17 wherein varying the header model comprises averaging a plurality of correct header values together.

19. The method according to claim 1 further comprising varying at least one performance parameter of the plurality of decoding chains to improve the likelihood that at least one decoding chain will correctly decode the received data.

20. The method according to claim 19 wherein varying at least one performance parameter of the plurality of decoding chains comprises varying filter settings of at least one of the plurality of decoding chains.

21. The method according to claim 20 wherein filter settings of the at least one of the plurality of decoding chains are varied autonomously.

22. A method for receiving downhole telemetry data from a drilling operation, the method comprising:

transmitting data from a downhole location by mud pulse telemetry;

receiving the transmitted mud pulse telemetry data at a plurality of transducers, each of the transducers positioned at a different location of the drilling operation;

processing the received data from the plurality of transducers to decode the transmitted data wherein processing the received data from the plurality of transducers comprises decoding the received data with a plurality of decoding chains;

selecting which one of the decoded data items most likely corresponds to the transmitted mud pulse telemetry data wherein selecting which one of the decoded data items most likely corresponds to the transmitted mud pulse telemetry data comprises selecting an output of one of the decoding chains which is the most likely to be correct; and wherein the output which is the most likely to be correct is determined by comparing confidence of a plurality of decoded data items.

23. The method according to claim 22 wherein the confidence of a decoded data item is based at least partially on a confidence value that a header corresponding to the decoded data item is correctly identified as a header.

24. The method according to claim 23 wherein detection of the header is based at least partially on a comparison of a suspected header to a header model.

25. The method according to claim 24 wherein the header model is varied as header values are correctly decoded.

26. The method according to claim 25 wherein varying the header model comprises averaging a plurality of correct header values together.

27. A method for receiving downhole telemetry data from a drilling operation, the method comprising:

transmitting data from a downhole location by mud pulse telemetry;

receiving the transmitted mud pulse telemetry data at a plurality of transducers, each of the transducers positioned at a different location of the drilling operation;

processing the received data from the plurality of transducers to decode the transmitted data wherein processing the received data from the plurality of transducers comprises decoding the received data with a plurality of decoding chains;

selecting which one of the decoded data items most likely corresponds to the transmitted mud pulse telemetry data;

varying at least one performance parameter of the plurality of decoding chains to improve the likelihood that at least one decoding chain will correctly decode the received data; and adding or removing decoding chains from the plurality of decoding chains.

28. The method according to claim 27 wherein the decoding chains are added or removed from the plurality of decoding chains autonomously.

* * * * *